US009238965B2

(12) United States Patent
Burgess

(10) Patent No.: US 9,238,965 B2
(45) Date of Patent: Jan. 19, 2016

(54) ROTARY PULSER AND METHOD FOR TRANSMITTING INFORMATION TO THE SURFACE FROM A DRILL STRING DOWN HOLE IN A WELL

(75) Inventor: Daniel E. Burgess, Portland, CT (US)

(73) Assignee: APS Technology, Inc., Wallingford, CT (US)

( * ) Notice: Subject to any disclaimer, the term of this patent is extended or adjusted under 35 U.S.C. 154(b) by 858 days.

(21) Appl. No.: 13/427,593

(22) Filed: Mar. 22, 2012

(65) Prior Publication Data

US 2013/0250728 A1 Sep. 26, 2013

(51) Int. Cl.
*E21B 47/18* (2012.01)

(52) U.S. Cl.
CPC ..... *E21B 47/187* (2013.01)

(58) Field of Classification Search
CPC ..... E21B 47/18; E21B 7/068; E21B 44/00; E21B 47/187; E21B 4/02
See application file for complete search history.

(56) References Cited

U.S. PATENT DOCUMENTS

| | | | |
|---|---|---|---|
| 2,901,685 | A | 8/1959 | Alder |
| 2,964,116 | A | 12/1960 | Peterson |
| 2,973,505 | A | 2/1961 | Johannesen |
| 3,065,416 | A | 11/1962 | Jeter |
| 3,302,457 | A | 2/1967 | Mayes |
| 3,309,656 | A | 3/1967 | Godbey |
| 3,693,428 | A | 9/1972 | Peuvedic |
| 3,713,089 | A | 1/1973 | Clacomb |
| 3,732,728 | A | 5/1973 | Fitzpatrick |
| 3,736,558 | A | 5/1973 | Cubberly |
| 3,737,843 | A | 6/1973 | Lepeuvedic |
| 3,739,331 | A | 6/1973 | Godbey |
| 3,742,443 | A | 6/1973 | Foster |
| 3,764,968 | A | 10/1973 | Anderson |
| 3,764,969 | A | 10/1973 | Cubberly |

(Continued)

FOREIGN PATENT DOCUMENTS

| | | | |
|---|---|---|---|
| CA | 2629835 | C | 7/2010 |
| EP | 0140788 | A2 | 5/1985 |

(Continued)

OTHER PUBLICATIONS

Chin, W.C. Ph.D., "MWD Siren Pulser Fluid Mechanics", StrataMagnetic Software, LLC, Houston Texas, Aug. 4, 2003, 1-23.
RE29734 Aug. 1978 Manning.

(Continued)

*Primary Examiner* — Kerri McNally
*Assistant Examiner* — Renee Dorsey
(74) *Attorney, Agent, or Firm* — Baker & Hostetler LLP

(57) ABSTRACT

A rotary pulser for transmitting information to the surface from down hole in a well by generating pressure pulses encoded to contain information. The pulser includes a rotor having blades that are capable of imparting a varying obstruction to the flow of drilling fluid through stator passages, depending on the circumferential orientation of the rotor, so that rotation of the rotor by a motor generates the encoded pressure pulses. A spring biases the rotor toward the stator so as to reduce the axial gap between the rotor and stator. When the pressure drop across the rotor becomes excessive, such as when increasing drilling fluid flow rate or switching from a high data rate to a low data rate transmission mode, the spring bias is overcome so as to increase the axial gap and reduce the pressure drop across the rotor, thereby automatically reducing the thrust load on the bearings.

33 Claims, 14 Drawing Sheets

(56) References Cited

U.S. PATENT DOCUMENTS

| | | | |
|---|---|---|---|
| 3,764,970 | A | 10/1973 | Manning |
| 3,770,006 | A | 11/1973 | Sexton |
| 3,958,217 | A | 5/1976 | Spinnler |
| 3,964,556 | A | 6/1976 | Gearhart |
| 4,007,805 | A | 2/1977 | Reber |
| RE29,734 | E | 8/1978 | Manning |
| RE30,055 | E | 7/1979 | Clacomb |
| 4,351,037 | A | 9/1982 | Scherbatskoy |
| 4,462,469 | A | 7/1984 | Brown |
| 4,499,563 | A | 2/1985 | Jurgens |
| 4,628,495 | A | 12/1986 | Peppers |
| 4,630,244 | A | 12/1986 | Larronde |
| RE32,463 | E | 7/1987 | Westlake |
| 4,698,794 | A | 10/1987 | Kruger |
| 4,734,892 | A | 3/1988 | Kotlyar |
| 4,785,300 | A | 11/1988 | Chin |
| 4,790,393 | A | 12/1988 | Larronde |
| 4,796,699 | A | 1/1989 | Upchurch |
| 4,847,815 | A | 7/1989 | Malone |
| 4,914,637 | A | 4/1990 | Goodsman |
| 4,915,168 | A | 4/1990 | Upchurch |
| 4,956,823 | A | 9/1990 | Russell |
| 5,073,877 | A | 12/1991 | Jeter |
| 5,079,750 | A | 1/1992 | Scherbatskoy |
| 5,113,379 | A | 5/1992 | Scherbatskoy |
| 5,119,344 | A | 6/1992 | Innes |
| 5,182,731 | A | 1/1993 | Hoelscher |
| 5,189,645 | A | 2/1993 | Innes |
| 5,215,152 | A | 6/1993 | Duckworth |
| 5,357,483 | A | 10/1994 | Innes |
| 5,517,464 | A | 5/1996 | Lerner |
| 5,586,084 | A | 12/1996 | Barron |
| 5,636,178 | A | 6/1997 | Ritter |
| 5,691,712 | A | 11/1997 | Meek |
| 5,787,052 | A | 7/1998 | Gardner |
| 6,105,690 | A | 8/2000 | Biglin |
| 6,219,301 | B1 | 4/2001 | Moriarty |
| 6,289,998 | B1 | 9/2001 | Krueger |
| 6,469,637 | B1 | 10/2002 | Seyler |
| 6,714,138 | B1 | 3/2004 | Turner |
| 7,327,634 | B2 | 2/2008 | Perry |
| 7,468,679 | B2 | 12/2008 | Feluch |

FOREIGN PATENT DOCUMENTS

| | | | |
|---|---|---|---|
| EP | 0140788 | A3 | 5/1985 |
| EP | 0325047 | B1 | 7/1989 |
| GB | 2156405 | A | 10/1985 |

OTHER PUBLICATIONS

Calmena Energy Services_Cyclone™ NC-RP Non Compensated Rotary Pulser brochure_DTB2010.2e.

Pulse Directional Technologies Inc., I-Pulse Brochure.

ROTARY PULSER AND METHOD FOR TRANSMITTING INFORMATION TO THE SURFACE FROM A DRILL STRING DOWN HOLE IN A WELL

FIELD OF THE INVENTION

The current invention is directed to a rotary pulser and method for transmitting information from a down hole location in a well to the surface, such as that used in a mud pulse telemetry system employed in a drill string for drilling an oil well.

BACKGROUND OF THE INVENTION

In underground drilling, such as gas, oil or geothermal drilling, a bore is drilled through a formation deep in the earth. Such bores are formed by connecting a drill bit to sections of long pipe, referred to as a "drill pipe," so as to form an assembly commonly referred to as a "drill string" that extends from the surface to the bottom of the bore. The drill bit is rotated so that it advances into the earth, thereby forming the bore. In rotary drilling, the drill bit is rotated by rotating the drill string at the surface. In directional drilling, the drill bit is rotated by a down hole mud motor coupled to the drill bit; the remainder of the drill string is not rotated during drilling. In a steerable drill string, the mud motor is bent at a slight angle to the centerline of the drill bit so as to create a side force that directs the path of the drill bit away from a straight line. In any event, in order to lubricate the drill bit and flush cuttings from its path, piston operated pumps on the surface pump a high pressure fluid, referred to as "drilling mud," through an internal passage in the drill string and out through the drill bit. The drilling mud then flows to the surface through the annular passage formed between the drill string and the surface of the bore.

Depending on the drilling operation, the pressure of the drilling mud flowing through the drill string will typically be between 1,000 and 25,000 psi. In addition, there is a large pressure drop at the drill bit so that the pressure of the drilling mud flowing outside the drill string is considerably less than that flowing inside the drill string. Thus, the components within the drill string are subject to large pressure forces. In addition, the components of the drill string are also subjected to wear and abrasion from drilling mud, as well as the vibration of the drill string.

The distal end of a drill string, which includes the drill bit, is referred to as the "bottom hole assembly." In "measurement while drilling" (MWD) applications, sensing modules in the bottom hole assembly provide information concerning the direction of the drilling. This information can be used, for example, to control the direction in which the drill bit advances in a steerable drill string. Such sensors may include a magnetometer to sense azimuth and accelerometers to sense inclination and tool face.

Historically, information concerning the conditions in the well, such as information about the formation being drill through, was obtained by stopping drilling, removing the drill string, and lowering sensors into the bore using a wire line cable, which were then retrieved after the measurements had been taken. This approach was known as wire line logging. More recently, sensing modules have been incorporated into the bottom hole assembly to provide the drill operator with essentially real time information concerning one or more aspects of the drilling operation as the drilling progresses. In "logging while drilling" (LWD) applications, the drilling aspects about which information is supplied comprise characteristics of the formation being drilled through. For example, resistivity sensors may be used to transmit, and then receive, high frequency wavelength signals (e.g., electromagnetic waves) that travel through the formation surrounding the sensor. By comparing the transmitted and received signals, information can be determined concerning the nature of the formation through which the signal traveled, such as whether it contains water or hydrocarbons. Other sensors are used in conjunction with magnetic resonance imaging (MRI). Still other sensors include gamma scintillators, which are used to determine the natural radioactivity of the formation, and nuclear detectors, which are used to determine the porosity and density of the formation. In traditional LWD and MWD systems, electrical power was supplied by a turbine driven by the mud flow. More recently, battery modules have been developed that are incorporated into the bottom hole assembly to provide electrical power.

In both LWD and MWD systems, the information collected by the sensors must be transmitted to the surface, where it can be analyzed. Such data transmission is typically accomplished using a technique referred to as "mud pulse telemetry." In a mud pulse telemetry system, signals from the sensor modules are typically received and processed in a microprocessor-based data encoder of the bottom hole assembly, which digitally encodes the sensor data. A controller in the control module then actuates a pulser, also incorporated into the bottom hole assembly, that generates pressure pulses within the flow of drilling mud that contain the encoded information. The pressure pulses are defined by a variety of characteristics, including amplitude (the difference between the maximum and minimum values of the pressure), duration (the time interval during which the pressure is increased), shape, and frequency (the number of pulses per unit time). Various encoding systems have been developed using one or more pressure pulse characteristics to represent binary data (i.e., bit 1 or 0)—for example, a pressure pulse of 0.5 second duration represents binary 1, while a pressure pulse of 1.0 second duration represents binary 0. The pressure pulses travel up the column of drilling mud flowing down to the drill bit, where they are sensed by a strain gage based pressure transducer. The data from the pressure transducers are then decoded and analyzed by the drill rig operating personnel.

Various techniques have been attempted for generating the pressure pulses in the drilling mud. One technique involves incorporating a pulser into the drill string in which the drilling mud flows through passages formed by a stator. In one type of pulser, referred to as a mud siren, a rotor, which is typically disposed adjacent the stator, is rotated continuously so that the rotor blades alternately increase and decrease the amount by which they obstruct the stator passages, thereby generating pulses in the drilling fluid. In another type of pulser, the rotor is oscillated so that the rotor blades alternately increase and decrease the amount by which they obstruct the stator passages, thereby generating pulses in the drilling fluid. Oscillating type pulser valves are disclosed in U.S. Pat. No. 6,714,138 (Turner et al.) and U.S. Pat. No. 7,327,634 (Perry et al.), each of which is hereby incorporated by reference in its entirety.

In such prior pulsers, when the rotor blades are aligned with the stator passages to create a pulse, the pressure drop across the rotor can be significant, especially when the flow rate of drilling mud through the pulser is high, or when the data rate is low so that the pulse width is relatively large, providing plenty of time for the buildup of pressure. This pressure drop places a considerable load on the thrust bearings that support the rotor. This load can be reduced by increasing the axial gap between the downstream face of the stator and the upstream face of the rotor, which allows greater fluid leakage around the rotor. However, such leakage reduces the slope of the pulse waveform, which results in a less desirable waveform for the pulse, especially when transmitting in a high data rate mode, in which short frequent pulses are generated. Adjusting the axial gap as the data rate changes between high and low pulse rates, or as the flow rate of the drilling mud changes, requires removal of the drill string and mechanical adjustments to the pulser.

Consequently, it would be desirable to provide a mud pulse telemetry system that could accommodate changes in data rate, or in the flow rate of the drilling mud, without the need to remove the pulser for modification.

SUMMARY OF THE INVENTION

It is an object of the current invention to provide a rotary pulser for transmitting information from a portion of a drill string operating at a down hole location in a well bore that comprises: a) a stator adapted to be mounted in the drill string and having at least one passage formed therein through which at least a portion of the drilling fluid flows; b) a rotor adapted to be mounted in the drill string adjacent the stator, the rotor being rotatable into at least first and second circumferential orientations, the rotor imparting a different degree of obstruction to the flow of drilling fluid flowing through the stator passage depending on the circumferential orientation of the rotor, the first rotor circumferential orientation providing a greater obstruction to the flow of drilling fluid than that of the second rotor circumferential orientation, whereby rotation of the rotor generates a series of pressure pulses encoded with the information to be transmitted, and whereby drilling fluid flowing through the pulser experiences a pressure drop across the rotor; c) means for automatically responding to a change in the pressure drop across the rotor so as to attenuate the change in the pressure drop. In one embodiment of the invention, a gap is formed between the rotor and the stator, and the means for automatically responding to a change in pressure drop across the pulser comprises means for varying the gap in response to the change in pressure drop.

It is another object of the invention to provide a method of transmitting encoded information from a portion of a bottom hole assembly of a drill string operating at a down hole location in a well bore to a location proximate the surface of the earth, the method comprising the steps of: a) obtaining data from a sensor located in the downhole portion of the drill string; b) rotating a rotor of a pulser mounted in the drill string adjacent a stator so as to generate a first series of pressure pulses in the drilling fluid into which information concerning the sensor data has been encoded, the first series of pressure pulses associated with a first pressure drop across the rotor that imparts a first force to the rotor; c) subsequently rotating the rotor so as to generate a second series of pressure pulses in the drilling fluid into which information concerning the sensor data has been encoded, the second series of pressure pulses associated with a second pressure drop across the rotor that imparts a second force to the rotor; d) automatically responding to a difference between the first and second pressure drops across the rotor so as to attenuate the difference. In one embodiment of the invention, the stator is mounted in the drill string adjacent the rotor so as to form a gap therebetween, and the step of automatically responding to a difference between the first and second pressure drops across the rotor so as to attenuate the difference comprises varying the size of the gap.

DETAILED DESCRIPTION OF ILLUSTRATIVE EMBODIMENTS

Figure 1:
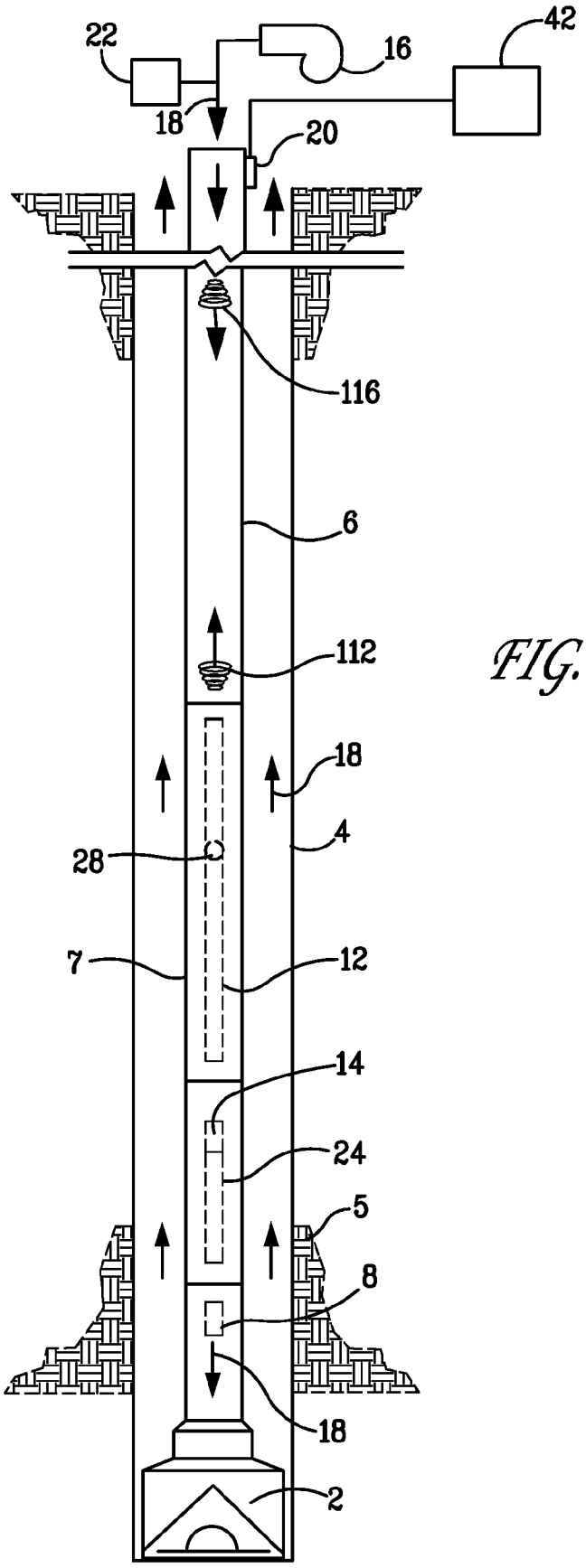
FIG. 1 is a diagram, partially schematic, showing a drilling operation employing the mud pulse telemetry system of the current invention.

A drilling operation incorporating a mud pulse telemetry system according to the current invention is shown in FIG. 1. A drill bit 2 drills a bore hole 4 into a formation 5. The drill bit 2 is attached to a drill string 6 that, as is conventional, is formed of sections of piping joined together. As is also conventional, a mud pump 16 pumps drilling mud 18 downward through the drill string 6 and into the drill bit 2. The drilling mud 18 flows upward to the surface through the annular passage between the bore 4 and the drill string 6, where, after cleaning, it is recirculated back down the drill string by the mud pump 16. As is conventional in MWD and LWD systems, sensors 8, such as those of the types previously discussed, are located in the bottom hole assembly portion 7 of the drill string 6. In addition, a surface pressure sensor 20, which may be a transducer, senses pressure pulses in the drilling mud 18. According to a preferred embodiment of the invention, a pulser device 22, such as a valve, is located at the surface and is capable of generating pressure pulses 116 in the drilling mud.

Figure 2:
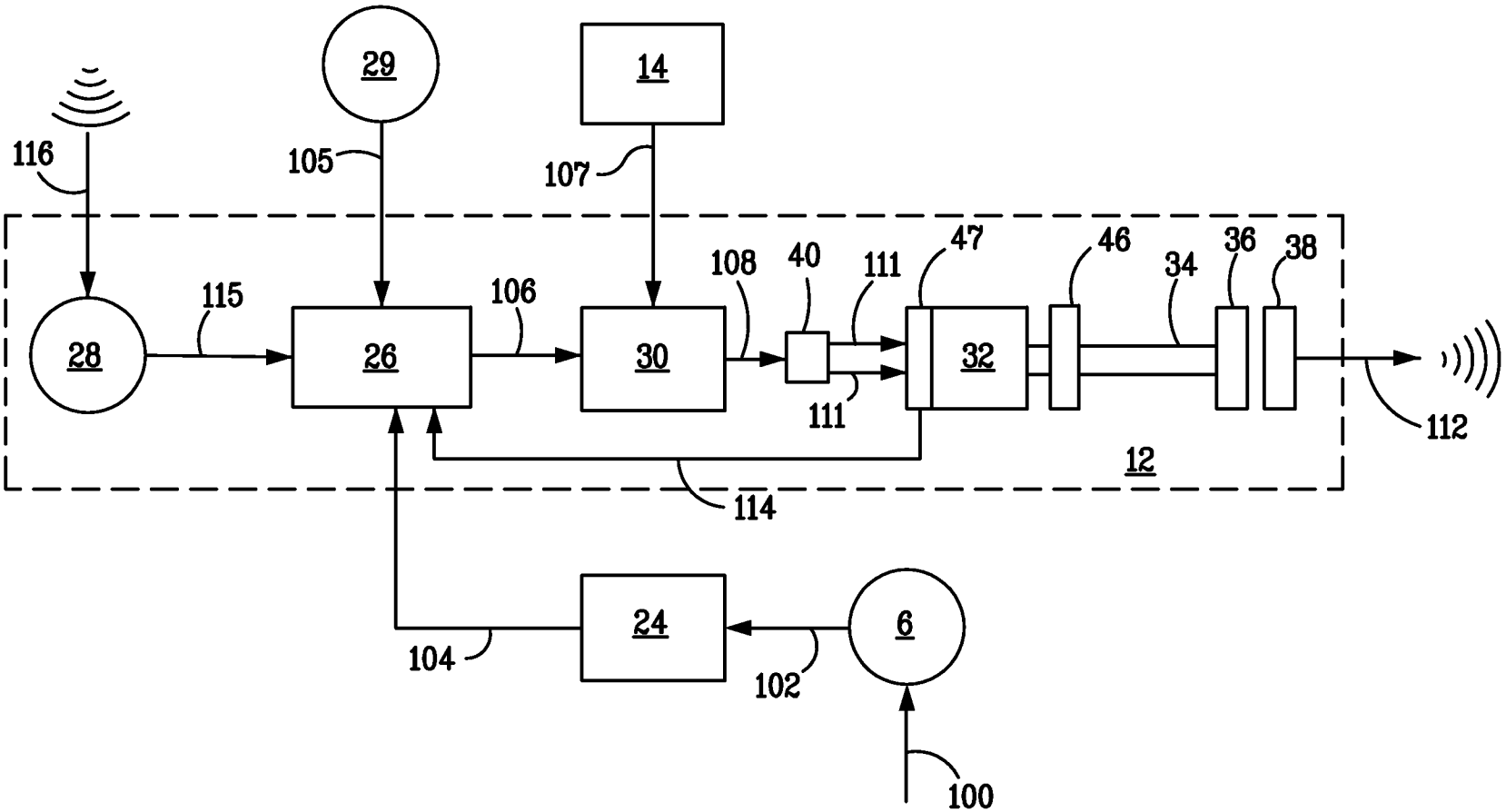
FIG. 2 is a schematic diagram of a mud pulser telemetry system according to the current invention.

As shown in FIG. 2, in addition to the sensors 8, the components of the mud pulse telemetry system according to the current invention include a conventional mud telemetry data encoder 24, a power supply 14, which may be a battery or turbine alternator, and a down hole pulser 12 according to the current invention. The pulser comprises a controller 26, which may be a microprocessor, a motor driver 30, which includes a switching device 40, a reversible motor 32, a reduction gear 46, a rotor 36 and stator 38. The motor driver 30, which may be a current limited power stage comprised of transistors (FET's and bipolar), preferably receives power from the power supply 14 and directs it to the motor 32 using pulse width modulation. Preferably, the motor is a brushless DC motor with an operating speed of at least about 600 RPM and, preferably, about 6000 RPM. The motor 32 drives the reduction gear 46, which is coupled to the rotor shaft 34. Although only one reduction gear 46 is shown, it should be understood that two or more reduction gears could also be utilized. Preferably, the reduction gear 46 achieves a speed reduction of at least about 80:1, and preferably at least 100:1. The sensors 8 receive information 100 useful in connection with the drilling operation and provide output signals 102 to the data encoder 24. Using techniques well known in the art, the data encoder 24 transforms the output from the sensors 8 into a digital code 104 that it transmits to the controller 26. Based on the digital code 104, the controller 26 directs control signals 106 to the motor driver 30. The motor driver 30 receives power 107 from the power source 14 and directs power 108 to a switching device 40. The switching device 40 transmits power 111 to the appropriate windings of the motor 32 so as to effect rotation of the rotor 36 in either a first (e.g., clockwise) or opposite (e.g., counterclockwise) direction so as to generate pressure pulses 112 that are transmitted through the drilling mud 18. The pressure pulses 112 are sensed by the sensor 20 at the surface and the information is decoded and directed to a data acquisition system 42 for further processing, as is conventional.

The current invention can also include a system for communicating information from the surface to the pulser 12. A system for communicating with downhole devices is described in U.S. Pat. No. 6,105,690 (Biglin et al.), incorporated by reference herein in its entirety. As shown in FIG. 2, preferably, both a down hole static pressure sensor 29 and a down hole dynamic pressure sensor 28 are incorporated into the drill string to measure the pressure of the drilling mud in the vicinity of the pulser 12, as described in the previously referenced U.S. Pat. No. 6,714,138 (Turner et al.). The pressure pulsations sensed by the dynamic pressure sensor 28 may be the pressure pulses generated by the down hole pulser 12 or the pressure pulses generated by the surface pulser 22. In either case, the down hole dynamic pressure sensor 28 transmits a signal 115 to the controller 26 containing the pressure pulse information, which may be used by the controller in generating the motor control signals 106. The down hole pulser 12 may also include an orientation encoder 47, suitable for high temperature applications, coupled to the motor 32. The orientation encoder 47 directs a signal 114 to the controller 26 containing information concerning the angular orientation of the rotor 36. Information from the orientation encoder 47 can be used to monitor the position of the rotor 36 during periods when the pulser 12 is not in operation and may also be used by the controller during operation in generating the motor control signals 106. Preferably, the orientation encoder 47 is of the type employing a magnet coupled to the motor shaft that rotates within a stationary housing in which Hall effect sensors are mounted that detect rotation of the magnetic poles.

Figure 3:
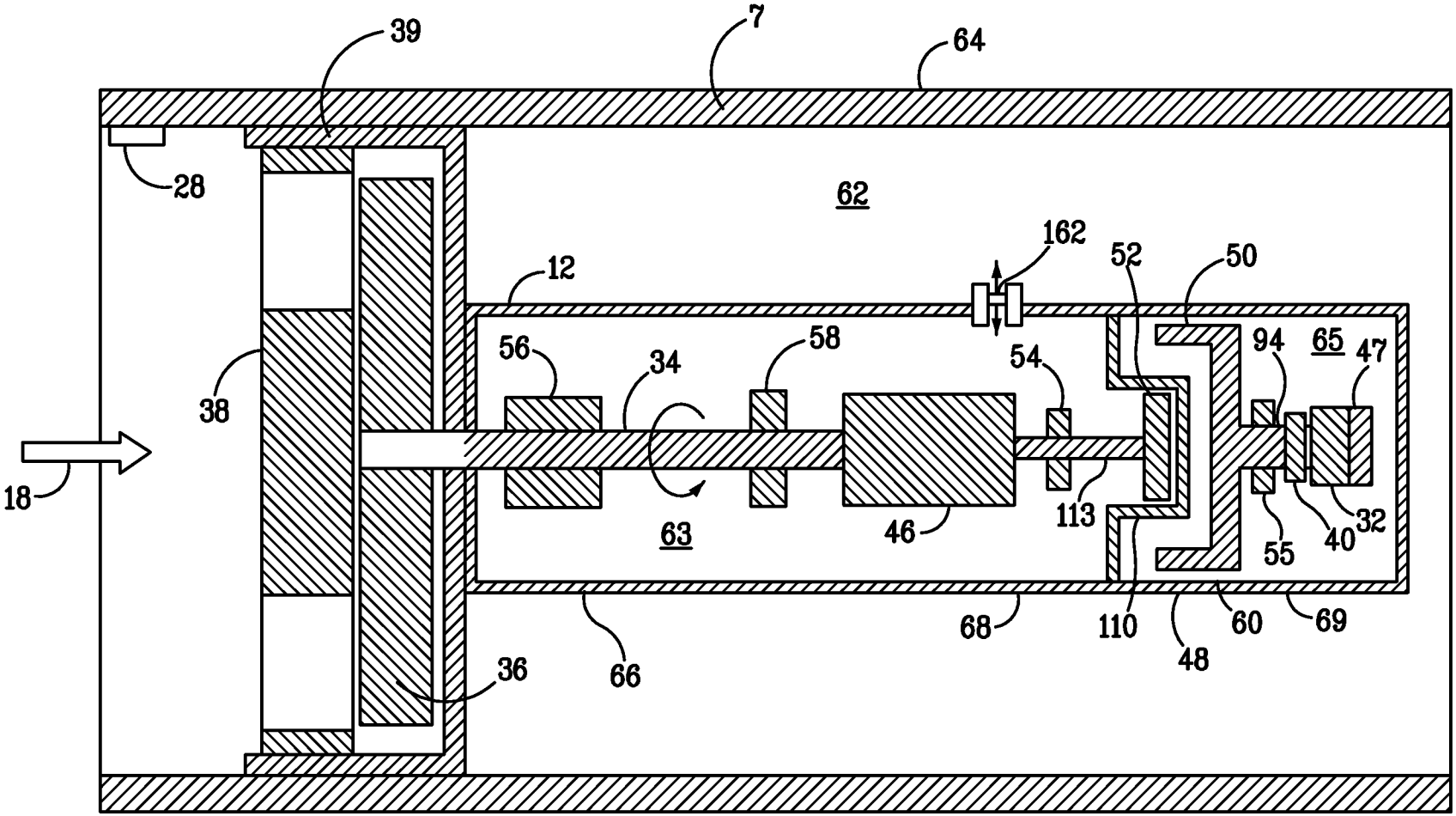
FIG. 3 is a diagram, partially schematic, of the mechanical arrangement of a pulser according to the current invention.
Figure 4:
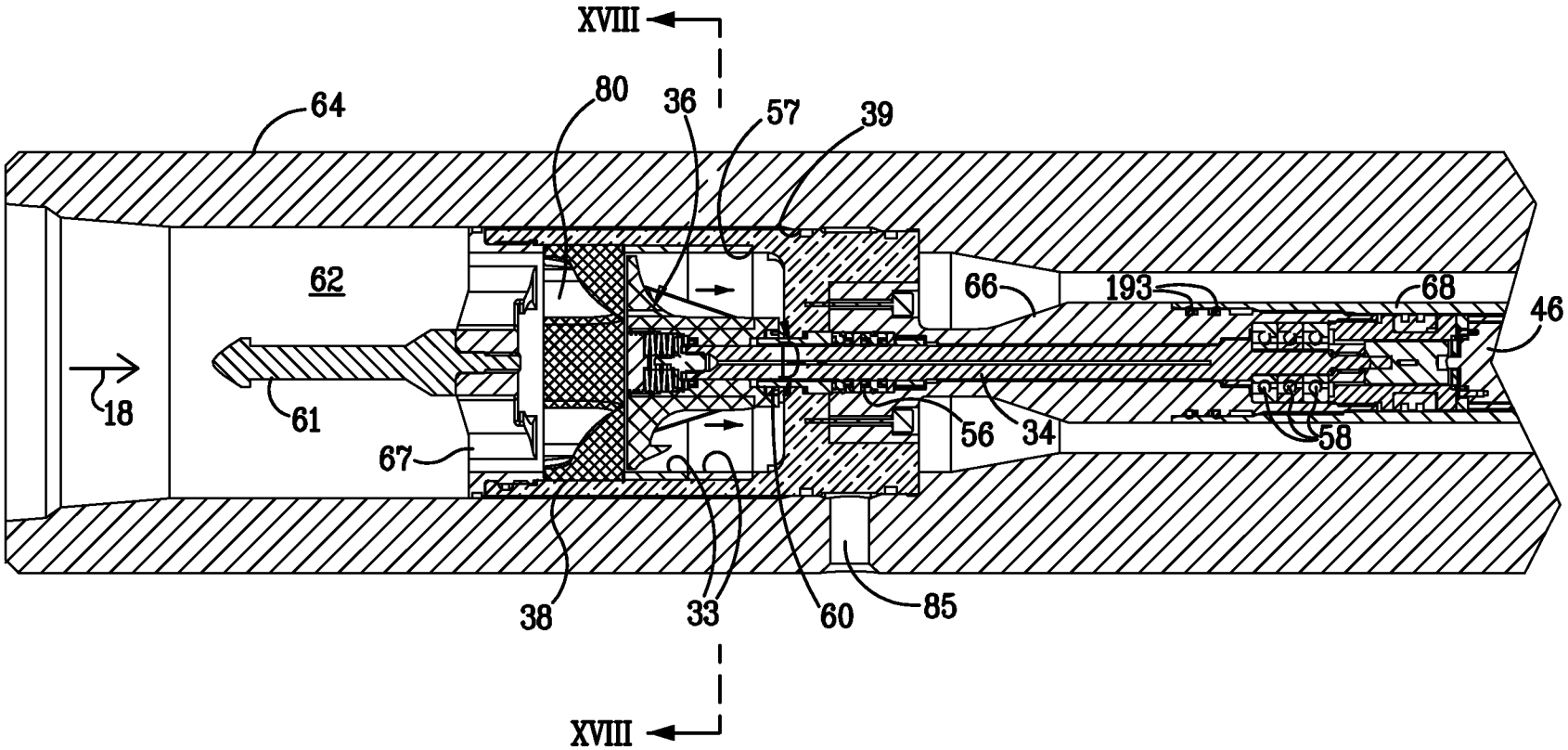
FIGS. 4-6 are consecutive portions of a longitudinal cross-section through a portion of the bottom hole assembly of the drill string shown in FIG. 1 incorporating the pulser shown in FIG. 2.
Figure 5:
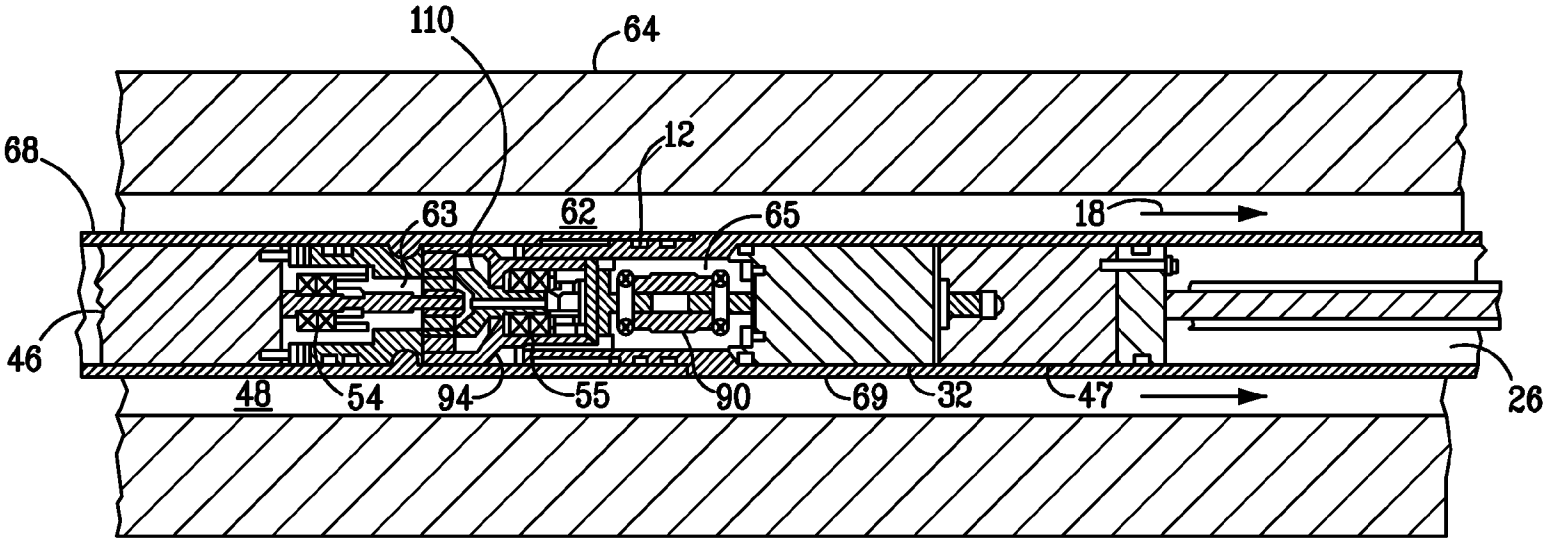
Figure 6:
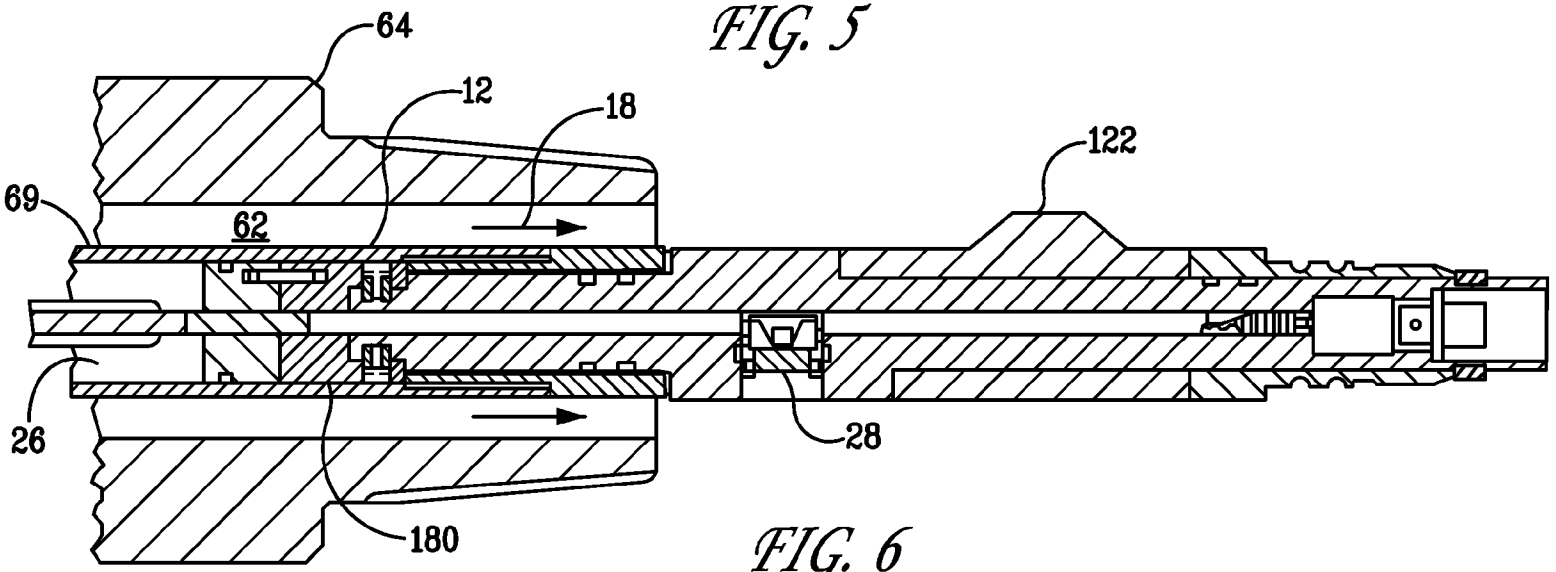

A preferred mechanical arrangement of the down hole pulser 12 is shown schematically in FIG. 3 and in more detail in FIGS. 4-7. FIG. 4 shows the upstream portion of the pulser, FIG. 5 shows the middle portion of the pulser, and FIG. 6 shows the downstream portion of the pulser. Details concerning the construction of the middle and downstream portions of the pulser are described in the previously referenced U.S. Pat. No. 6,714,138 (Turner et al.) and U.S. Pat. No. 7,327,634 (Perry et al.).

As previously discussed, the outer housing of the drill string 6 is formed by a section of drill pipe 64, which forms the central passage 62 through which the drilling mud 18 flows. As is conventional, the drill pipe 64 has threaded couplings on each end, shown in FIGS. 4 and 6, that allow it to be mated with other sections of drill pipe. The housing for the pulser 12 is comprised of an annular shroud 39, and housing portions 66, 68, and 69, and is mounted within the passage 62 of the drill pipe section 64. As shown in FIG. 4, the upstream end of the pulser 12 is mounted in the passage 62 by the annular shroud 39. As shown in FIG. 6, the downstream end of the pulser 12 is attached via coupling 180 to a centralizer 122 that further supports it within the passage 62.

Figure 8:
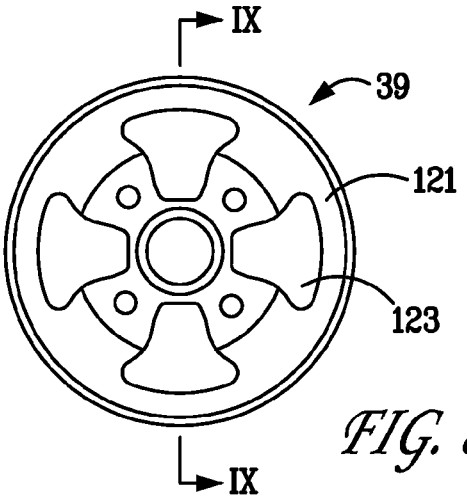
FIG. 8 is an end view of the annular shroud shown in FIG. 4.
Figure 9:
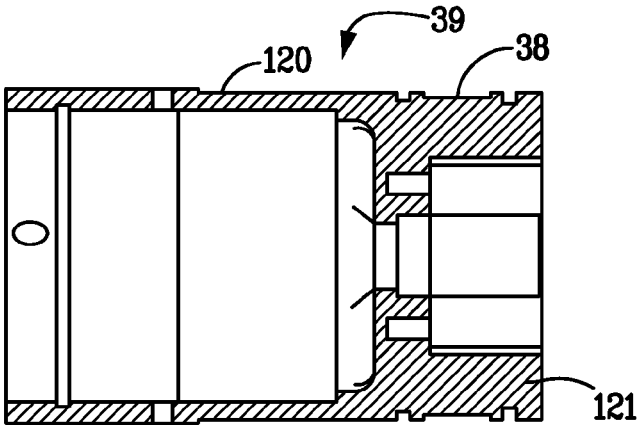
FIG. 9 is a cross-section of the annular shroud shown in FIG. 4 taken through line IX-IX shown in FIG. 8.

The annular shroud 39, shown in FIGS. 8 and 9, comprises a sleeve portion 120 forming a shroud for the rotor 36 and stator 38, as discussed below, and an end plate 121. As shown in FIG. 4, tungsten carbide wear sleeves 33 enclose the rotor 36 and protect the inner surface of the shroud 39 from wear as a result of contact with the drilling mud. Passages 123 are formed in the end plate 121 that allow drilling mud 18 to flow through the shroud 39. The shroud is fixed within the drill pipe 64 by a set screw (not shown) that is inserted into a hole 85 in the drill pipe. As shown in FIG. 4, a nose 61 forms the forward most portion of the pulser 12. The nose 61 is attached to a stator retainer 67, shown in FIG. 4.

The rotor 36 and stator 38 are mounted within the shroud 39, with the rotor 36 being located downstream of the stator 38. The stator retainer 67 is threaded into the upstream end of the annular shroud 39 and restrains the stator 38 and the wear sleeves 33 from axial motion by compressing them against a shoulder 57 formed in the shroud 39. Thus, the wear sleeves 33 can be replaced as necessary. Moreover, since the stator 38 and wear sleeves 33 are not highly loaded, they can be made of a brittle, wear resistant material, such as tungsten carbide, while the shroud 39, which is more heavily loaded but not as subject to wear from the drilling fluid, can be made of a more ductile material, such as 17-4 stainless steel.

The rotor 36 is driven by a drive train mounted in the pulser housing and includes a rotor shaft 34 mounted on upstream and downstream bearings 56 and 58 in a chamber 63. The chamber 63 is formed by upstream and downstream housing portions 66 and 68 together with a seal 60 and a barrier member 110 (as used herein, the terms upstream and downstream refer to the flow of drilling mud toward the drill bit). The seal 60 is a spring loaded lip seal. The chamber 63 is filled with a liquid, preferably a lubricating oil, that is pressurized to an internal pressure that is close to that of the external pressure of the drilling mud 18 by a piston mounted in the upstream oil-filed housing portion 66. The upstream and downstream housing portions 66 and 68 that form the oil filled chamber 63 are threaded together, with the joint being sealed by O-rings 193.

The rotor 36 is preferably located immediately downstream of the stator 38. The upstream face 72 of the rotor 36 is spaced from the downstream face 71 of the stator 38 by a gap G, shown in FIGS. 7 and 12. Since, as discussed below, the upstream surface 72 of the rotor 36 is preferably substantially flat, the axial gap G between the stator outlet face 71 and the rotor upstream surface is preferably, although not necessarily, substantially constant over the radial height of a blade 74 of the rotor. The rotor 36 includes a rotor shaft 34, which is mounted within the oil-filled chamber 63 by the upstream and downstream bearings 56 and 58. The downstream end of the rotor shaft 34 is attached by a coupling 182 to the output shaft of the reduction gear 46, which may be a planetary type gear train, such as that available from Gysin AG of Itingen, Switzerland, and which is also mounted in the downstream oil-filled housing portion 68. The input shaft 113 to the reduction gear 46 is supported by a bearing 54 and is coupled to inner half 52 of a magnetic coupling 48, such as that available through Magnetic Technologies, Ltd. of Oxford, Mass.

In operation, the motor 32 rotates a shaft 94 which, via the magnetic coupling 48, transmits torque through a housing barrier 110 that drives the reduction gear input shaft 113. The reduction gear 46 drives the rotor shaft 34, thereby rotating the rotor 36. The outer half 50 of the magnetic coupling 48 is mounted within housing portion 69, which forms a chamber 65 that is filled with a gas, preferably air, the chambers 63 and 65 being separated by the barrier 110. The outer magnetic coupling half 50 is coupled to a shaft 94 which is supported on bearings 55. A flexible coupling 90 couples the shaft 94 to the electric motor 32, which rotates the drive train. The orientation encoder 47 is coupled to the motor 32. The down hole dynamic pressure sensor 28 is mounted on the downhole end of the pulser, as shown in FIG. 6.

Figure 16:
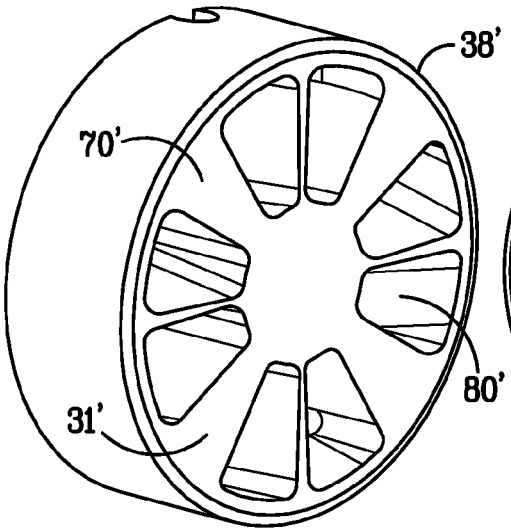
FIGS. 16 and 17 are isometric and end views, respectively, of an alternate embodiment of the stator shown in FIGS. 10 and 11.
Figure 17:
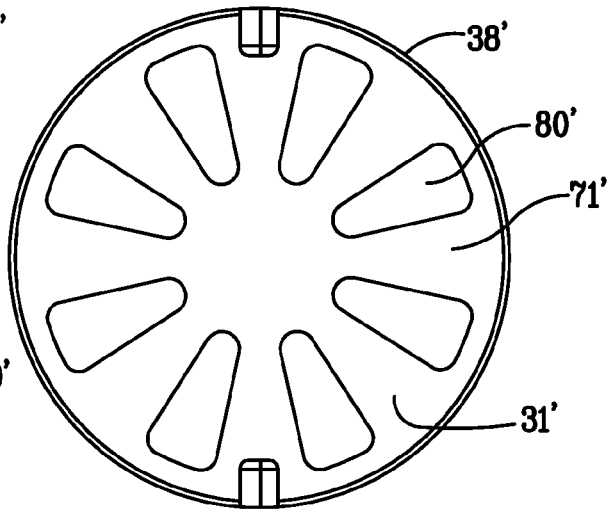
Figure 10:
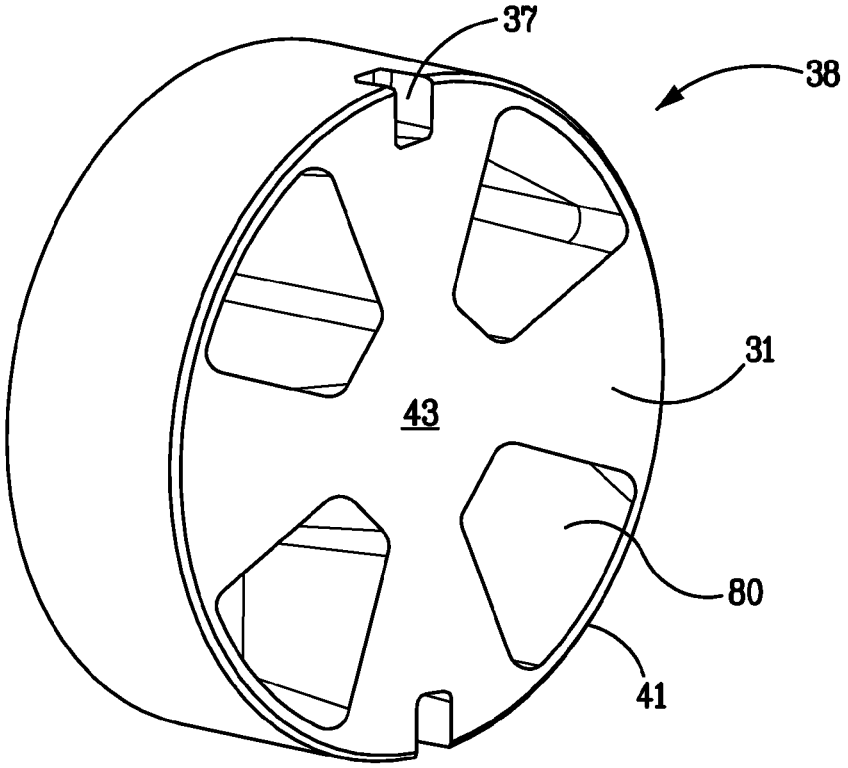
FIGS. 10 and 11 are isometric and end views, respectively, of the stator shown in FIG. 4.
Figure 11:
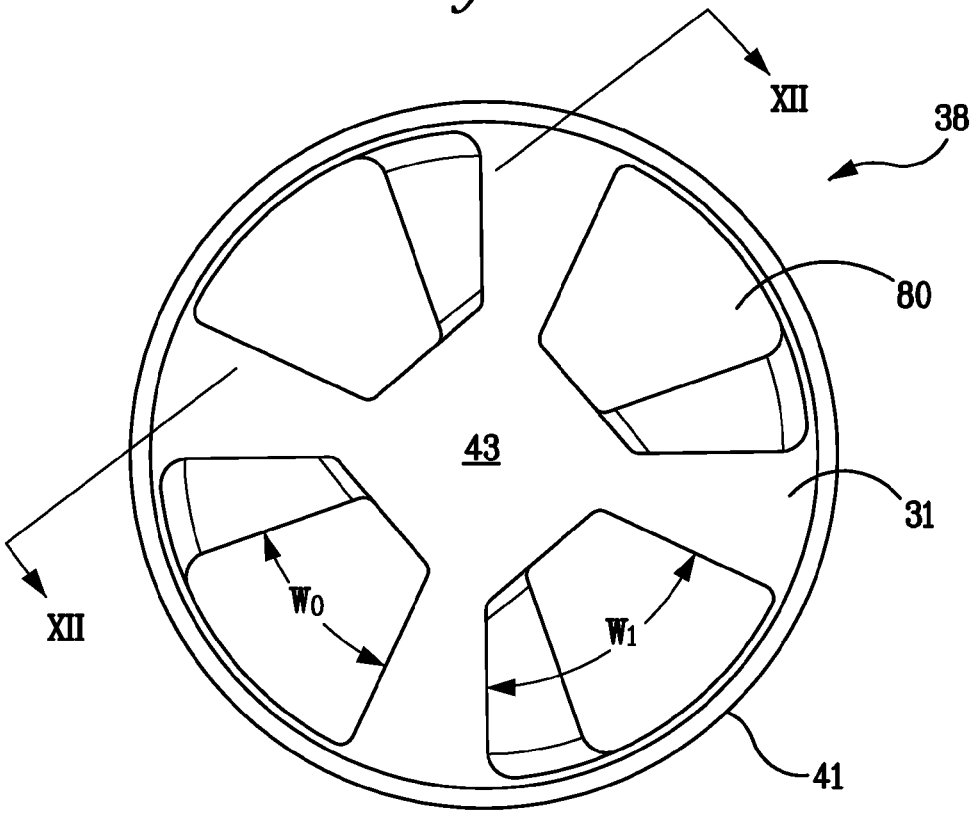
Figure 12:
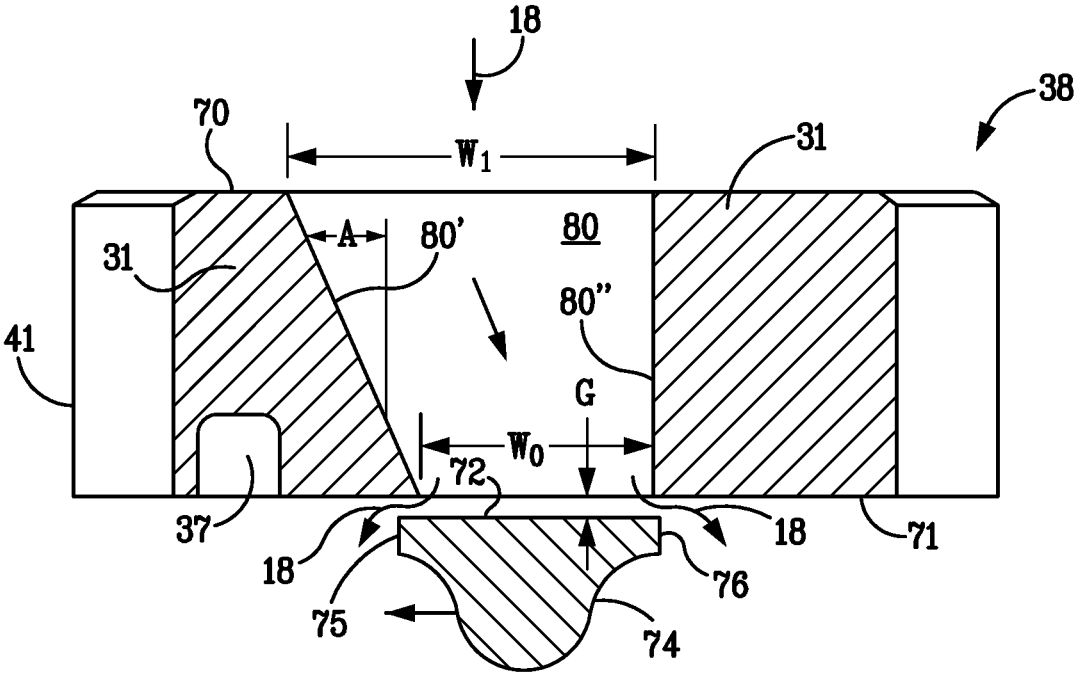
FIGS. 12 and 13 are transverse cross-sections of the stator shown in FIG. 4 taken through line XII-XII shown in FIG. 11 showing the downstream rotor blade in two circumferential orientations.
Figure 13:
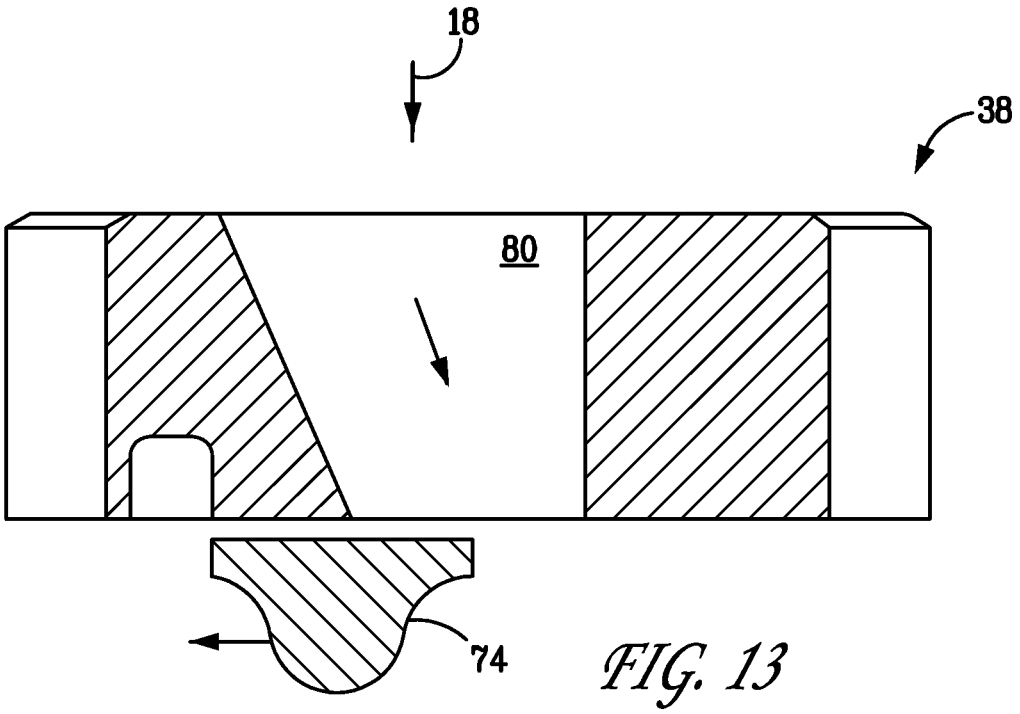

As shown in FIGS. 10 and 11, the stator 38, which is preferably made of tungsten carbide for wear resistance, is comprised of a hub 43, an outer rim 41, and vanes 31 extending therebetween that form four axial passages 80 for the flow of drilling mud. FIGS. 16 and 17 shown an alternate embodiment of a stator 38' in which the vanes 31' form eight passages 80'. Locating pins (not shown) extend into grooves 37 in the rim 41, shown in FIG. 10, to circumferentially orient the stator 38 with respect to the remainder of the pulser. The stator 38 preferably swirls the drilling mud 18 as it flows through the passages 80. As shown in FIG. 12, this swirling is preferably accomplished by inclining one of the walls 80' of the passage 80 at an angle A to the axial direction. The angle A preferably increases as the passage 80 extends radially outward and is preferably in the range of approximately 10° to 15°. The other wall 80" of the passage 180 is oriented in a plane parallel to the central axis so that the circumferential width $W_i$ of the passage 80 at the inlet face 70 of the stator 38 is larger than the width $W_o$ at the outlet face 71. However, both walls of the passages could also be inclined if preferred.

Figure 14:
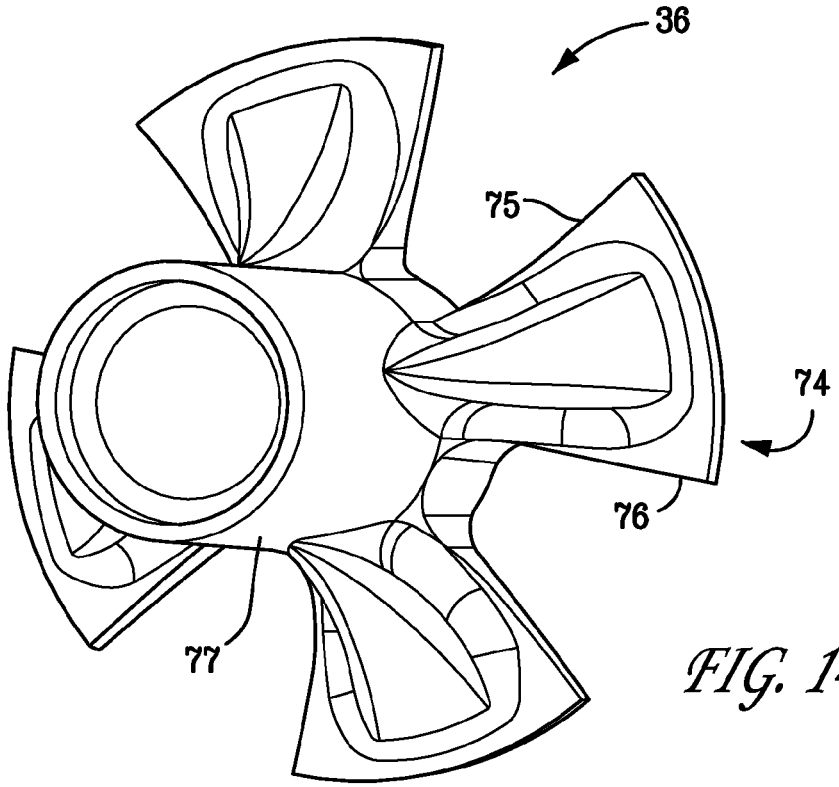
FIGS. 14 and 15 are isometric and side views, respectively, of the rotor shown in FIG. 4.
Figure 15:
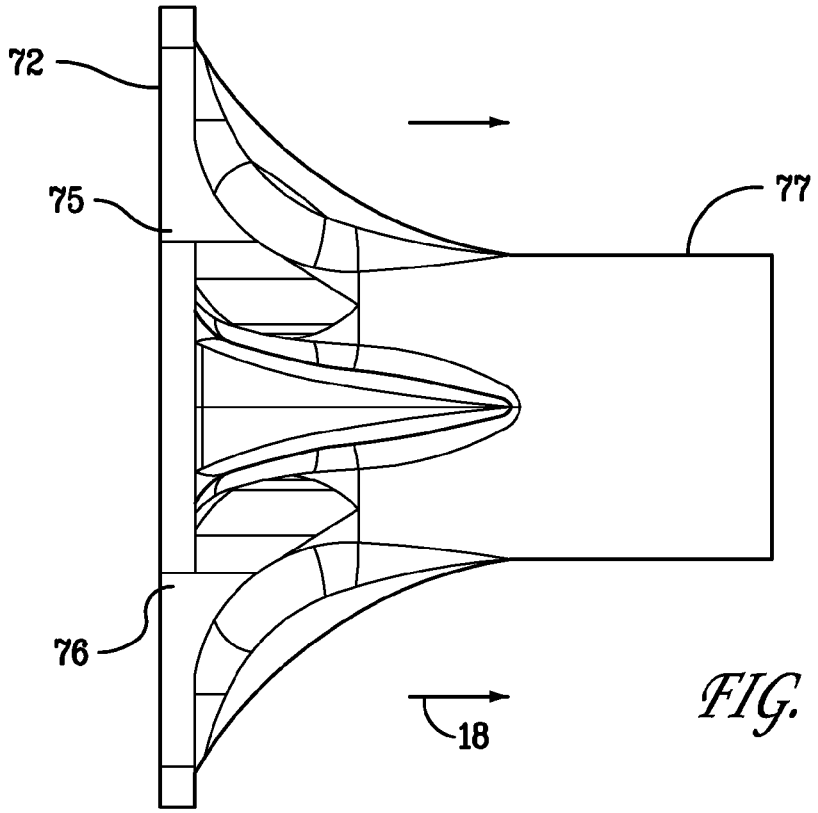

As shown in FIGS. 14 and 15, the rotor 36 is comprised of a central hub 77 from which a plurality of blades 74 extend radially outward. The blades 74 have leading and trailing edges 75 and 76, respectively, and are capable of imparting a varying obstruction to the flow of drilling mud 18 depending on the circumferential orientation of the rotor 36 relative to the stator 38. Although four blades are shown in FIG. 14, a greater or lesser number of blades could also be utilized.

Figure 18A:
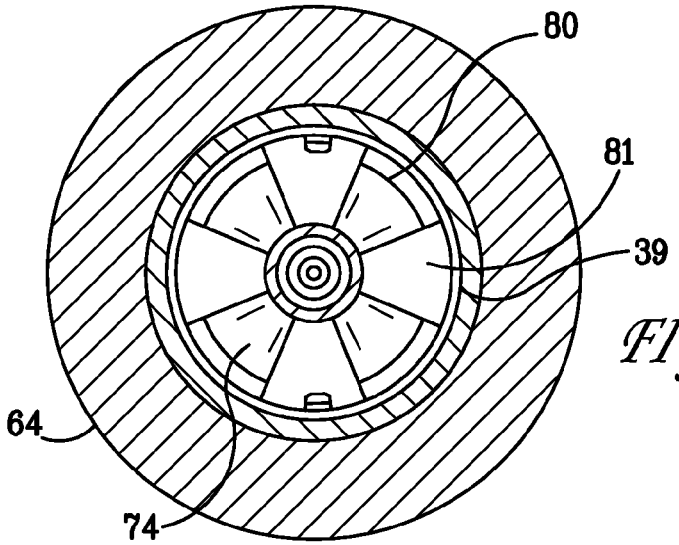
FIGS. 18A, B, and C are cross-sections of the pulser taken along line XVIII-XVIII shown in FIG. 4 with the rotor in three circumferential orientations—(a) maximum obstruction, (b) intermediate obstruction, and (c) minimum obstruction.
Figure 18B:
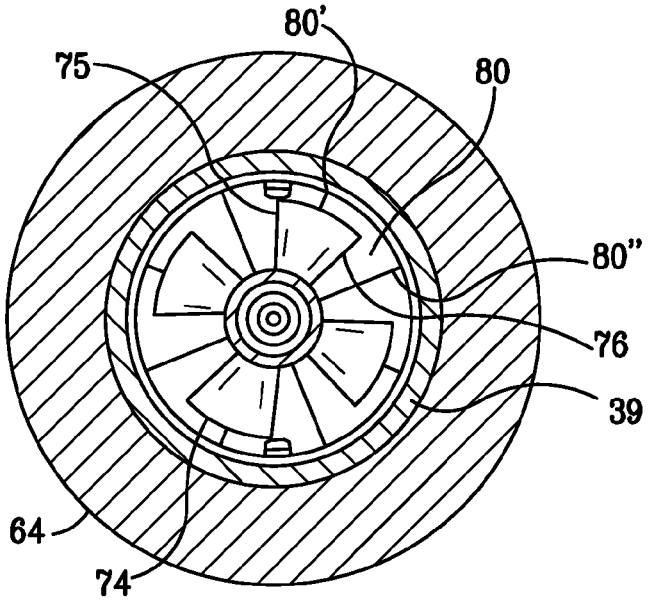
Figure 18C:
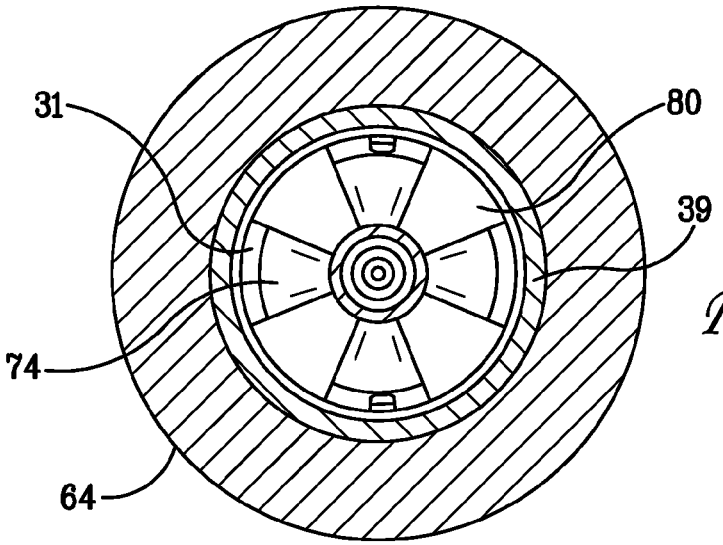
Figure 19:
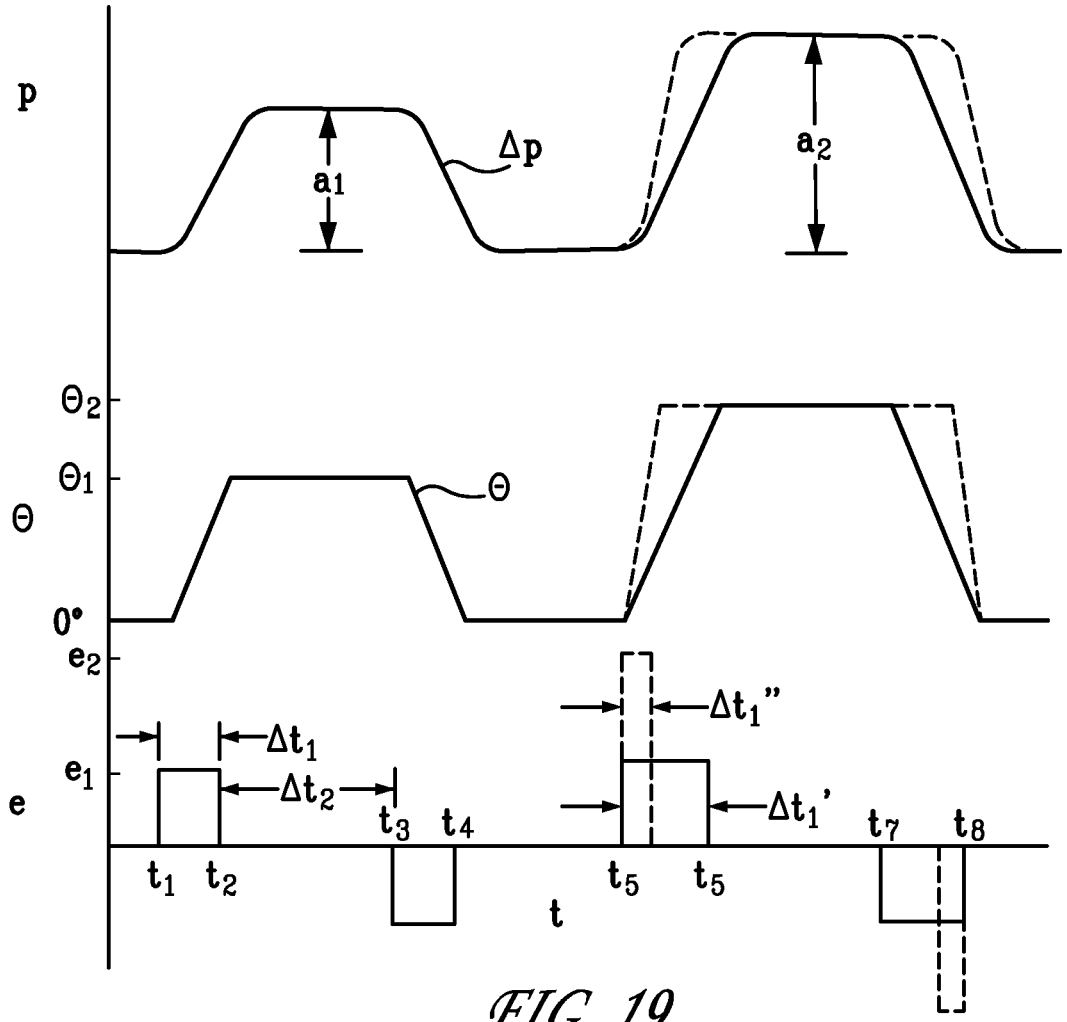
FIG. 19 is a graph showing the timing relationship of the electrical power e transmitted from the motor driver to the motor (lower curve) to the angular orientation of the rotor $\theta$ (middle curve) and the resulting pressure pulse $\Delta P$ generated at the pulser (upper curve).

The operation of the rotor 36 according to the current invention, and the resulting pressure pulses in the drilling mud 18, are shown in FIGS. 18 and 19, respectively. Preferably, the circumferential expanse of the rotor blades 74 is about the same as, or slightly less than, that of the stator vanes 31. Thus, when the rotor 36 is a first angular orientation, arbitrarily designated as the 0° orientation in FIG. 19, the rotor blades 74 are aligned with the stator vanes 31, as shown in FIG. 18C. In this orientation, the blades 74 provide essentially no obstruction of the flow of drilling mud 18 through the passage 80, thereby minimizing the pressure drop across the pulser 12. However, when the rotor 36 has been rotated in the clockwise direction by an angle $\theta_1$, the rotor blades 74 partially obstruct the passages 80, thereby increasing the pressure drop across the pulser 12. (Whether a circumferential direction is "clockwise" or "counterclockwise" depends on whether the viewer is oriented upstream or downstream from the pulser 12. Therefore, as used herein, the terms clockwise and counterclockwise are arbitrary and intended to convey only opposing circumferential directions.)

If the rotor 36 is thereafter rotated back to the 0° orientation, a pressure pulse is created having a particular shape and amplitude $a_1$, such as that shown in FIG. 19. If, in another cycle, the rotor 36 is rotated further in the circumferential direction from the 0° orientation to angular orientation $\theta_2$, the degree of obstruction and, therefore, the pressure drop will be increased, resulting in a pressure pulse having another shape and a larger amplitude $a_2$, such as that also shown in FIG. 19. Therefore, by adjusting the magnitude and speed of the rotational oscillation $\theta$ of the rotor 36, the shape and amplitude of the pressure pulses generated at the pulser 12 can be adjusted. Further rotation beyond $\theta_2$ will eventually result a rotor orientation providing the maximum blockage of the passage 80, shown in FIG. 18A. However, in the preferred embodiment of the invention, the expanse of the rotor blades 74 and stator passages 80 is such that complete blockage of flow is never obtained regardless of the rotor orientation.

The control of the rotor rotation so as to control the pressure pulses will now be discussed. In general, the controller 26 translates the coded data from the data encoder 24 into a series of discrete motor operating time intervals. For example, as shown in FIG. 19, in one operating mode, it is assumed to that the rotor is initially at the 0° orientation, in which the rotor blades 74 are aligned with the vanes 31 so as to not obstruct the flow as shown in FIG. 18C. At time $t_1$, the controller 26 directs the motor driver 30 to transmit an increment of electrical power of amplitude $e_1$ to the motor 32. After a short time lag, due to inertia, the motor 32 will begin rotating in the circumferential direction, thereby rotating the rotor 36 in the same direction.

At time $t_2$, after an elapse of time interval $\Delta t_1$, the controller will direct the motor driver 30 to cease the transmission of electrical power to the motor 32 so that, after a short lag time due to inertia, the rotor 36 will stop, at which time it will have reached angular orientation $\theta_1$, which, for example, may be 20°, as shown in FIG. 18B. This will result in an increase in the pressure sensed by the surface sensor 20 of $a_1$. At time $t_3$, after an elapse of time interval $\Delta t_2$, the controller 26 directs the motor driver 30 to again transmit electrical power of amplitude $e_1$ to the motor 32 for another time interval $\Delta t_1$, but now in the opposite direction—that is, the counterclockwise direction—so that the rotor 36 returns back to the 0° orientation, thereby returning the pressure to its original magnitude. The result is the creation of a discrete pressure pulse having amplitude $a_1$ and a width of $\Delta t_2$. Generally, the shape of the pressure pulse will depend upon the relative lengths of the timer intervals $\Delta t_1$ and $\Delta t_2$ and the speed at which the rotor moved between the 0° and $\theta_1$ orientations—the faster the speed, the more square-like the pressure pulse, the slower the speed, the more sinusoidal or trapezoidal the pressure pulse.

It will be appreciated that the time intervals $\Delta t_1$ and $\Delta t_2$ may be very short, for example, $\Delta t_1$ might be on the order of 0.18 second and $\Delta t_2$ on the order of 0.32 seconds. Moreover, the interval $\Delta t_2$ between operations of the motor could be essentially zero so that the motor reversed direction as soon as stopped rotating in the first direction.

After an elapse of another timer interval, which might be equal to $\Delta t_2$ or a longer or shorter time interval, the controller 26 will again direct the motor driver 30 to transmit electrical power of $e_1$ to the motor 32 for another time interval $\Delta t_1$ in the clockwise direction and the cycle is repeated, thus generating pressure pulses of a particular amplitude, duration, and shape and at particular intervals as required to transmit the encoded information.

The control of the characteristics of the pressure pulses, including their amplitude, shape and frequency, afforded by the present invention provides considerably flexibility in encoding schemes. For example, the coding scheme could involve variations in the duration of the pulses or the time intervals between pulses, or variations in the amplitude or shape of the pulses, or combinations of the foregoing. In addition to allowing adjustment of pressure pulse characteristics (including amplitude, shape and frequency) to improve data reception, a more complex pulse pattern could also be effected to facilitate efficient data transmission. For example, the pulse amplitude could be periodically altered—e.g., every third pulse having an increased or decreased amplitude. Thus, the ability to control one or more of the pressure pulse characteristics permits the use of more efficient and robust coding schemes. For example, coding using a combination of pressure pulse duration and amplitude results in fewer pulses being necessary to transmit a given sequence of data.

Significantly, the control over the characteristics of the pressure pulses afforded by the current invention allows adjustment of these characteristics in situ in order to optimize data transmission. Thus, it is not necessary to cease drilling and withdraw the pulser in order to adjust the amplitude, duration, shape or frequency of the pressure pulses as would have been required with some prior art systems.

For example, the amplitude of the pressure pulses could be increased by increasing the time interval $\Delta t_1'$ during which the motor operates (for example, by increasing the duration over which electrical power of amplitude $e_1$ is transmitted to the motor). The increased motor operation increases the amount of rotation of the rotor 36 so that it assumes angular orientation $\theta_2$, for example 45°, as shown in FIG. 18A, thereby increasing the obstruction of the stator passages 80 by the rotor blades 74 and the pressure drop across the pulser 12. Counter rotation of the rotor 36 back to the 0° orientation will result in the completion of the generation of a pressure pulse of increased amplitude $a_2$. Operation is this mode will improve reception of data by the surface pressure sensor 20.

Alternatively, data reception at the surface may be improved by altering the shape of the pressure pulse. For example, suppose that, after a period of time, the pressure pulses of increased amplitude $a_2$ also became difficult to decipher at the surface. According to the invention, the controller 26 could then direct the motor driver 30 to increase the amplitude of the electrical power transmitted to the motor to amplitude $e_2$ while also decreasing the time interval $\Delta t_1''$ during which such power was supplied. The transmission of increased electrical power will increase the speed of rotation of the rotor 36 so that it assumes angular orientation $\theta_2$ sooner and also returns to its initial position sooner, resulting in a pressure pulse that more nearly approximates a square wave. This type of operation is depicted by the dashed lines in FIG. 19. Alternatively, if it were desired to increase the frequency of the pressure pulses, for example, to avoid confusion with noise existing at a certain frequency, the time intervals $\Delta t_1$ and $\Delta t_2$ during which the rotor is operative and inoperative, respectively, could be shortened or lengthened by the controller 26. Further, in situations in which there were no problems with data reception, the time intervals could be shortened to increase the rate of data transmission, resulting in the transmission of more data over a given time interval.

Figure 20:
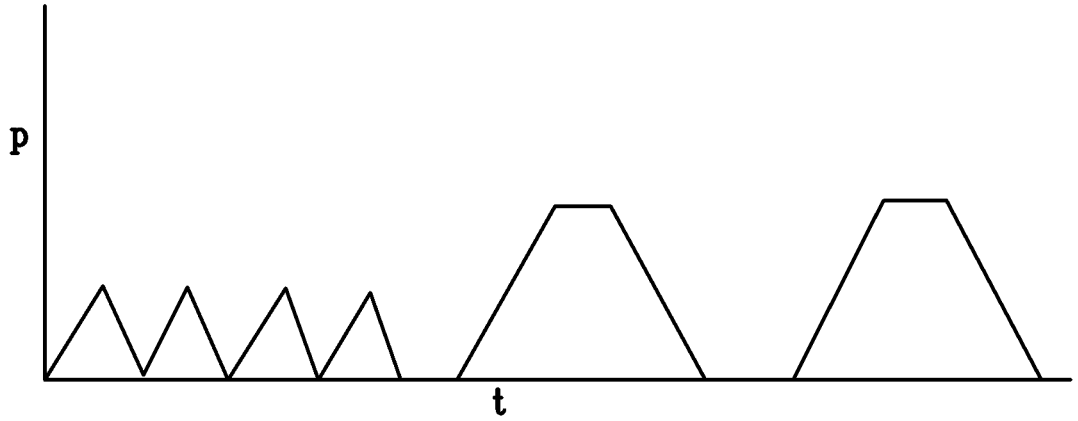
FIG. 20 is a graph showing pressure pulses generated over time with the pulser switching from a high data rate to a low data rate transmission mode.

According to the current invention, based on information transmitted in the form of data encoded pulses from the surface that are generated by the surface pulser 20 and received by the downhole dynamic pressure sensor 29, as previously discussed, instructions could be transmitted from the surface that, when decoded by the controller 26, directs the controller to increase the magnitude of the electrical power supplied to the motor by a specific amount so that the rotor rotated more rapidly thereby altering the shape of the pressure pulses, or to increase the duration of each interval during which the motor was energized thereby increasing the duration and amplitude of the pressure pulses, or to increase the time interval between each energizing of the motor thereby decreasing the frequency, or data rate. FIG. 20 illustrates switching the pulser 12 from a high data rate transmission mode, in which short frequent pulses are created, to a low data rate transmission mode, in which longer pulses are created at longer intervals. Such switching can occur based on instructions transmitted from the surface, as discussed above.

In one version, the controller 26 automatically directs the down hole pulser 12 to transmit pressure pulses 112 in a number of predetermined formats, such as a variety of data rates, pulse frequencies or pulse amplitudes, at prescribed intervals. The down hole pulser 12 would then cease operation while the surface detection system analyzed these data, selected the format that afforded optimal data transmission, and, using the surface pulser 22, generated encoded pressure pulses 116 instructing the controller 26 as to the down hole pulser operating mode to be utilized for optimal data transmission.

Alternatively, the controller 26 could be informed that it was about to receive instructions for operating the down hole pulser 12 by sending to the controller the output signal from a conventional flow switch mounted in the bottom hole assembly, such as a mechanical pressure switch that senses the pressure drop in the drilling mud across an orifice, with a low $\Delta P$ indicating the cessation of mud flow and a high $\Delta P$ indicating the resumption of mud flow, or an accelerometer that sensed vibration in the drill string, with the absence of vibration indicating the cessation of mud flow and the presence of vibration indication the resumption of mud flow. The cessation of mud flow, created by shutting down the mud pump, could then be used to signal the controller 26 that, upon resumption of mud flow, it would receive instructions for operating the pulser 12.

According to the invention, the mud pump 16 can be used as the surface pulser 22 by using a very simple encoding scheme that allowed the pressure pulses generated by mud pump operation to contain information for setting a characteristic of the pressure pulses generated by the down hole pulser 12. For example, the speed of the mud pump 16 could be varied so as to vary the frequency of the mud pump pressure pulses that, when sensed by the down hole dynamic pressure sensor 29, signal the controller 26 that a characteristic of the pressure pulses being generated by the down hole pulser 12 should be adjusted in a certain manner.

Figure 7A:
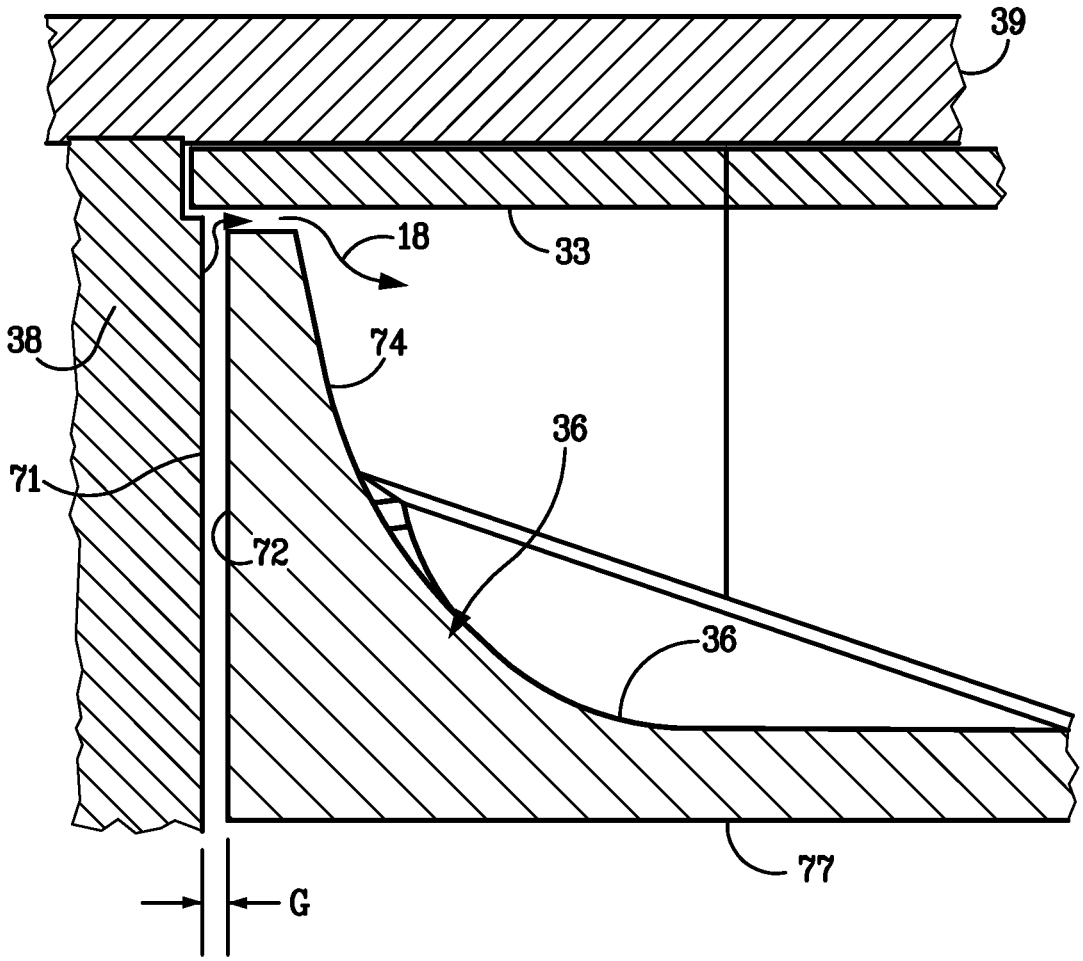
FIG. 7A is a detailed view of a portion of the pulser shown in FIG. 4 in the vicinity of the rotor blade tip.

As shown in FIGS. 7A and 12, there is an axial gap G between the downstream face 71 of the stator vane 31 and the upstream face 72 of the rotor 36. As shown in FIG. 7A, the clearance between the tip of the rotor blade 74 and the sleeve 33 provides a leakage path for drilling mud 18 around the rotor 36. However, even if there were no clearance between the tip of the rotor blade 74 and sleeve 33 and the circumferential width of the blade was equal to or greater than the circumferential width of the stator passage 80, there would still be a leakage flow path around the rotor 36 because the drilling mud 18 can flow around the sides of the blade 74 as a result of the axial gap G, as shown in FIG. 12. Consequently, the larger the gap G, the greater the leakage flow area through the pulser and, therefore, the less the pressure drop across the rotor. Similarly, the smaller the gap G, the smaller the leakage flow area through the pulser and the larger the pressure drop across the rotor.

As discussed above, the pulser 12 can generate pulses of varying pulse amplitudes and pulse widths. However, in general, the higher the flow rate of drilling fluid through the pulser 12, the higher the pressure drop across the pulser rotor 36. Moreover, the greater the pulse width, the greater the pulse amplitude because longer pulses provide more time for the pressure to build, the greater the pulse amplitude, the greater the pressure drop across the pulser rotor 36. The higher pressure drop increases the load on the downstream bearings 58 (shown in FIG. 4), which are preferably combined radial/thrust bearings. For example, when operating in a low data rate mode with wide pressure pulses, the pressure drop across the rotor 36 can exceed 500 psi. Such pressure drop can impose an axial load that exceeds the maximum allowable thrust load of the bearings 58, which in one embodiment of the invention is 2000 lb. Increasing the axial gap G between the downstream face of the stator 71 and the upstream face 72 of the rotor 36 reduces this pressure drop. Thus, excessive pressure drops can be prevented by increasing the axial gap G, for example, by adding shims. However, increases in the gap G result in a lessening of the slope of the pulse waveform, which increases the time over which the pressure will build up. This is undesirable when transmitting in a high data rate mode, in which the pulser generates short frequent pulses, since it will result in less distinct pulses of smaller amplitudes.

According to the invention, variations in drilling fluid flow rate and pulse width can be automatically accommodated so that, for example, the flow rate of drilling fluid can be increased, or the pulser 12 can be switched from a high data rate to a low data rate mode, illustrated in FIG. 20, without the need to retrieve the pulser and manually adjust the axial gap G to prevent overloading the hearings. This is accomplished by automatically varying the flow area of the leakage flow path around the rotor in response to a change in pressure drop across the rotor so as to attenuate the change in the pressure drop. According to a preferred embodiment, the variation in the flow area of the leakage flow path is accomplished by varying the leakage flow path around the rotor 36, preferably by varying the size of the axial gap G.

Figure 7B:
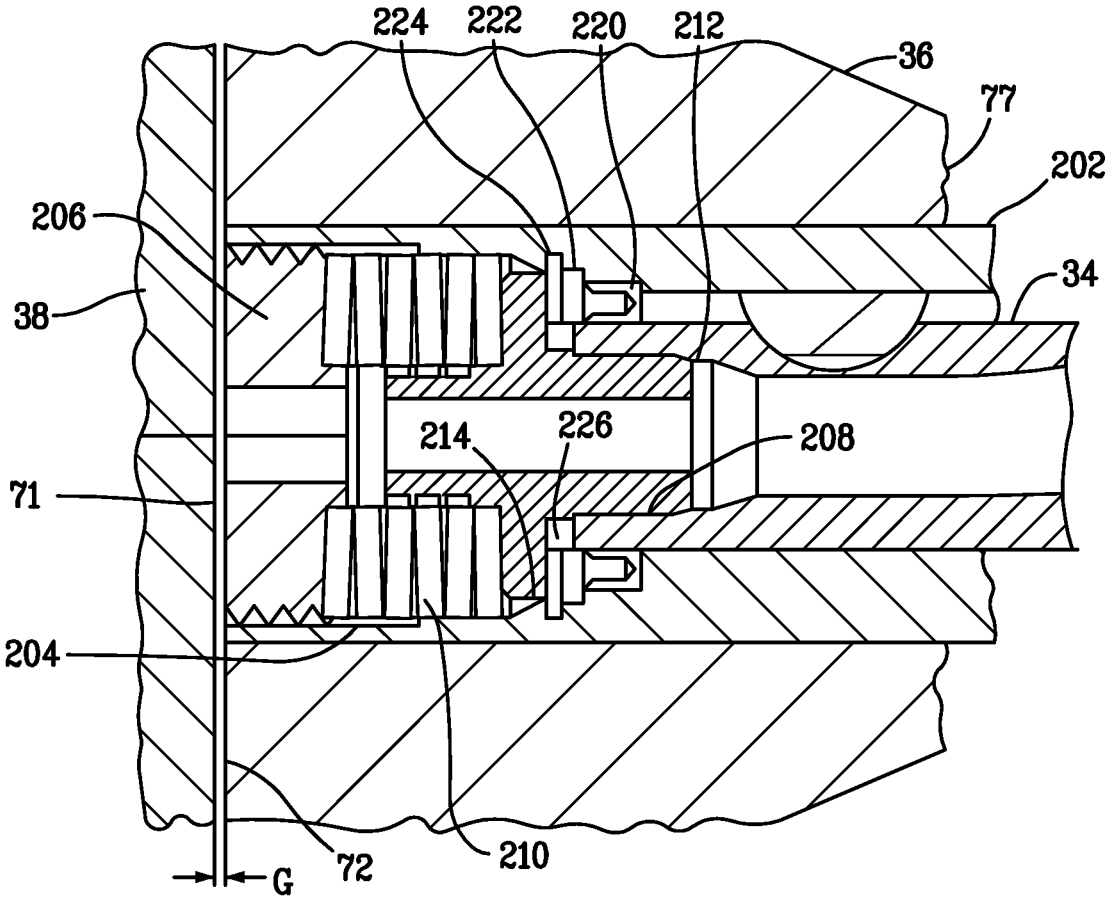
FIG. 7B is a detailed view of a portion of the pulser shown in FIG. 4 in the vicinity of the rotor hub.

As shown in FIG. 7B, the hub 77 of the rotor 36 is affixed to a sleeve 202, preferably by brazing. The sleeve 202 is keyed to the rotor shaft 34 and can slide along the rotor shaft—that is, it can be displaced toward or away from the stator 38. A seal 220 is disposed in the sleeve 202 and is held in place by a seal retainer 222 which, in turn, is retained by retaining rings 224. A cavity 204 is formed in the uphole end of the shaft 34, a portion of which is threaded. A nut 206 engages the threads formed in the cavity 204. A stub shaft 208, with threads formed on its outer surface, engages threads formed in a recess 212 in the end of the rotor shaft 34. A through passage is formed in the nut 206 and stub shaft 208 that allows the drilling mud to act against a compensation piston. A spring 210 is disposed between the nut 206 and a flange 214 formed on the stub shaft 208. Preferably the spring 210 is comprised of a stack of Belleville springs. However, other types of springs, such as a helical compression spring, could also be utilized. Threading the nut 206 into the cavity 204 at assembly compresses the spring 210—in other words, it preloads the spring—and displaces the rotor 36 toward the stator 38, thereby reducing the initial gap G. In a preferred embodiment, the initial gap G is set at 0.030 inch. The retaining rings 224 also act as stops to ensure that the rotor 36 does not contact the stator 38. Shims 226 aid in accurately setting the minimum gap G between the rotor and stator.

The pressure drop across the rotor 36 exerts a force that tends to drive the rotor in the downhole direction—that is, to the right in FIGS. 4 and 7B—so that it slides along the shaft 34. In so doing, the spring 210 becomes compressed. Since the downhole displacement of the rotor 36 compresses the spring 210, the spring exerts a biasing force that resists such downhole displacement. In addition to compressing the spring 210, the displacement of the rotor 36 also increases the gap G.

As discussed above, operation of the pulser 12 results in a pressure drop across the rotor 36 that creates a force tending to drive the rotor 36 in the downhole direction so as to increase the gap G. Thus, in operation, the axial position of the rotor 36 with respect to the rotor shaft 34 and, therefore, the size of the gap G between the downstream face 71 of the stator 38 and the upstream face 72 of the rotor 36, is the result of a balance between the force generated by the pressure drop across the rotor and the opposing force generated by the spring 210. The larger the pressure drop, the larger the axial gap G, which will tend to attenuate the increase in pressure drop because of the increased leakage of drilling fluid 18 around the rotor 36.

For example, in one embodiment of the invention, the nut 206 is threaded into the cavity 204 at assembly so that it applies a preload to the spring 210 of approximately 1000 lbs. This 1000 lb preload is equal to the force generated by a pressure drop across the rotor 36—that is, a pressure pulse amplitude $a_1$—of about 250 psi. This results in an axial gap G of 0.030 inch at zero pressure drop. During operation, pressure drops below 250 psi will have no effect on the gap G because the force generated by such pressure drops is insufficient to overcome the preload and compress the spring 210. However, pressure drops in excess of 250 psi will overcome the preload on the spring 210 and drive the rotor 36 in the downhole direction so as to increase the axial gap G above 0.030 inch. For example, suppose that the flow rate of drilling fluid through the pulser increased significantly. Or, as another example, suppose, as a result of a command from the surface, the pulser 12 switched from a high data rate to a low rate operating mode, resulting in a doubling of the width of the pulse. The increased pulse width will provide additional time for the amplitude of the pressure pulse (and the pressure drop across the rotor 36) to build up. In such situations, pulsers according to the prior art might experience an increase in the load on the bearings that would shorten the life of the pulser, which could only be avoided by removing the bottom hole assembly and manually adjusting the axial gap G.

According to the current invention, increases in pressure drop across the rotor 36, such as from an increase in drilling fluid flow rate or in the pulse width associated from switching to a high data rate to a low data rate transmission mode, are automatically accommodated by increases in the axial gap G. In the example above, when the force due to the pressure drop exceeds the 250 lbs of preload, the spring 210 will begin to compress sufficiently to generate an equally large force opposing the pressure drop force. In so doing, the axial gap G will increase, thereby attenuating the magnitude of the increase in pressure drop across the rotor. Similarly, if the pressure drop across the rotor was sufficient to exceed the preload in the spring 210, such that compression of the spring caused an increase in the gap G, then a subsequent decrease in the pressure drop will result in a decrease in the axial gap G that attenuates the magnitude of the decrease in the pressure drop across the rotor, and thereby attenuates the decrease in pulse height.

For example, the 0.030 inch initial axial gap G mentioned above may increase to 0.080 inch when the pressure drop across the rotor 36 reaches 500 psi, at which the force from the pressure drop acting on the rotor will be 2000 lbs and will cause the spring 210 to compress until it generates an equally large opposing force. In particular, the magnitude of the increase in the axial gap G resulting from an increase in pressure beyond that needed to overcome the preload applied by the nut 206 to the spring 210 will depend on the spring constant of the spring 210. In the example above, the spring constant of the spring 210 is such that a deflection of 0.050 inch resulted in an increase in the spring force so that an axial gap of 0.080 inch was sufficient to balance the increased force on the rotor 36 due to the increase in the pressure drop. Of course, the specific numbers mentioned above are by way of example only and, based on the teaching provided herein, other axial gaps and spring constants could be selected based on the particular application. Thus, pulsers according to the current invention can accommodate larger variations in drilling fluid flow rate, as well as larger variations in pulse width, without experiencing excessive thrust loads on the bearings because the size of the gap G automatically responds to a change in pressure drop so as to attenuate the change in pressure drop. For example, the current invention allows the gap G to be initially set to a relatively small value so that, at low flow rates, the amplitude of the pressure pulse is adequate. Yet at high flow rates, excessive pressure drops are avoided. Without the automatic adjustment in the gap G afforded by the invention, the gap G would have to be initially set high enough to accommodate the largest expected fluid flow rate to be encountered without imposing excessive load on the bearings, which would result in less than optimum pulse height at lower flow rates.

Figure 21:
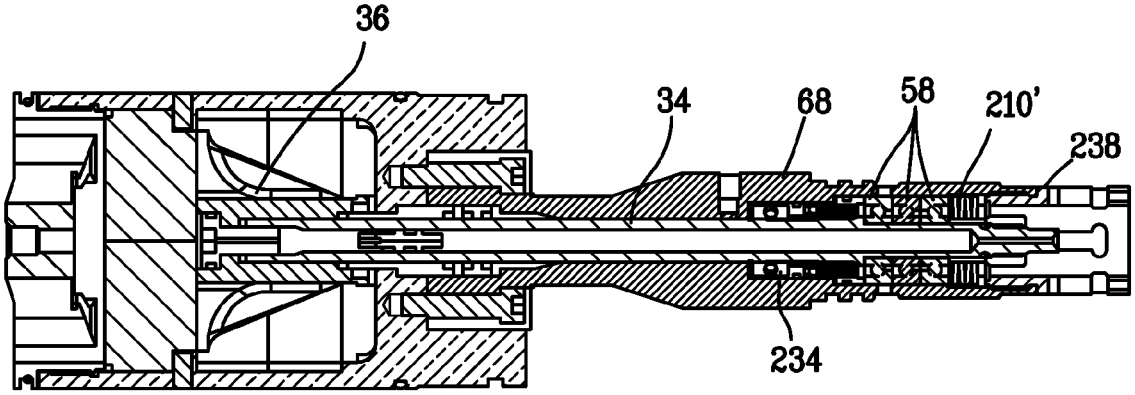
FIG. 21 shows an alternate embodiment of the invention in which a spring in the vicinity of the bearings acts on the rotor shaft to resist displacement of the shaft relative to the stator.

FIG. 21 shows an alternate embodiment of the invention in which the spring 210' is incorporated adjacent the bearings 58. In this embodiment, the rotor 36 does not slide relative to the shaft 34. However, the shaft 34 can be displaced relative to the housing 68. The spring is arranged between the bearings 58 and a sleeve 238 that is fixed to the housing 68. An increase in pressure drop across the rotor 36 will cause the rotor shaft 34 to be displaced in the downstream direction—to the right in FIG. 21—relative to the housing 68. In so doing, the gap G will be increased, as before, thereby attenuating the increase in the pressure drop, and the spring 210' will be compressed, thereby resisting further displacement, as before.

Figure 22A:
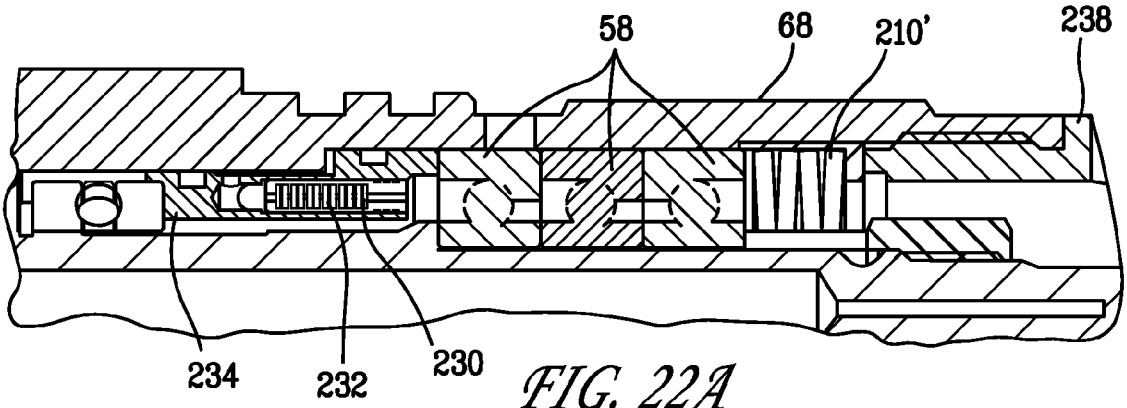
FIGS. 22A and B are detailed views of the embodiment shown in FIG. 21 in the vicinity of the piston, showing the piston in two positions.
Figure 22B:
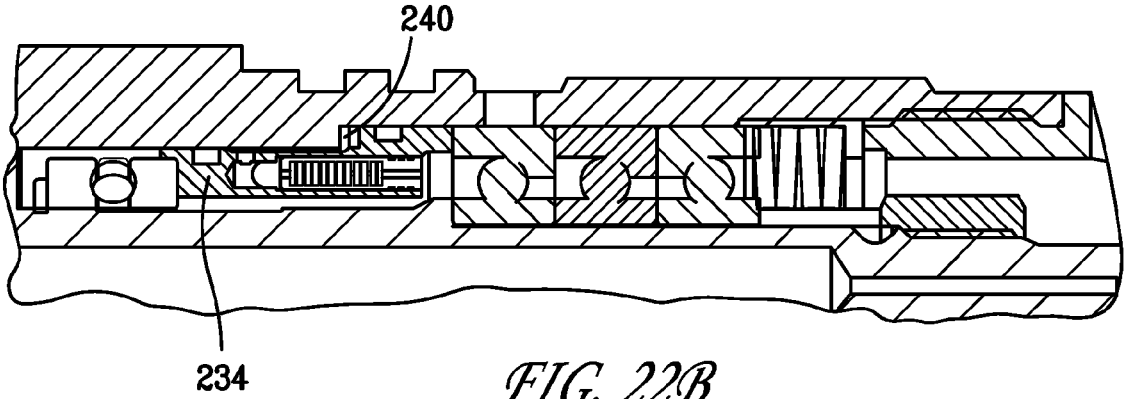

A further feature of the embodiment of FIG. 21 is the ability to damp the axial displacement of the rotor 36. The area in which the bearings 58 are located is oil-filled. Displacement of the rotor shaft 34 in the downhole direction causes displacement of a piston 234 that acts on the oil, as shown in FIG. 22B. The displacement of the piston 234 causes fluid to be pumped in the uphole direction, through a check valve 230, into a chamber 240. If the pressure drop is subsequently reduced, the spring 210' will drive the rotor shaft 34 in the uphole direction so that the piston 234 pumps the oil in the opposite direction, as shown in FIG. 22A. However, a flow restrictor valve 232, comprised of a series of plates with holes staggered to create a long and winding path for the oil, retards the pumping of the oil and so slows down the displacement of the piston 234 and, therefore, the rotor shaft 34. Consequently, the displacement of the rotor 36 is damped, preventing the rotor from experiencing small but rapid displacements fore and aft due to minor fluctuations in the pressure drop, such as those that arise when each pulse is created. This prevents unnecessary wear on the seals and other sliding surfaces associated with the rotor 36.

Although the current invention has been illustrated by reference to certain specific embodiments, those skilled in the art, armed with the foregoing disclosure, will appreciate that many variations could be employed. For example, although the invention has been discussed in detail with reference to an oscillating type rotary pulser, the invention could also be utilized in a pulser that generated pulses by rotating a rotor in only one direction. Thus, for example, reference to a rotor "circumferential orientation" that results in a minimum obstruction to the flow of drilling fluid applies to any orientation in which the rotor blades 36 are axially aligned with the stator vanes so that, for example, in the structure shown in FIG. 18 in which the stator vanes 31 are spaced at 90° intervals, both the rotor orientation shown in FIG. 18(*c*) as well as an orientation in which the rotor was rotated 90°, 180°, and 270° therefrom would all be considered as a single, or first, circumferential orientation since in each of these cases the rotor blades would be axially aligned with the stator vanes. Similarly, both the rotor orientation shown in FIG. 18(*a*) as well as an orientation that was 90°, 180°, and 270° therefrom would all be considered as a single, or second, circumferential orientation since in each of these cases the rotor blades would be axially aligned with the stator passages 80.

Therefore, it should be appreciated that the current invention may be embodied in other specific forms without departing from the spirit or essential attributes thereof and, accordingly, reference should be made to the appended claims, rather than to the foregoing specification, as indicating the scope of the invention.

What is claimed:

1. A rotary pulser for transmitting information from a portion of a drill string operating at a down hole location in a well bore, said drill string having a passage through which a drilling fluid flows, comprising:

a) a stator adapted to be mounted in said drill string and having at least one passage formed therein through which at least a portion of said drilling fluid flows;

b) a rotor adapted to be mounted in said drill string proximate said stator, said rotor being rotatable into at least first and second circumferential orientations, said rotor imparting a different degree of obstruction to said flow of drilling fluid flowing through said stator passage depending on the circumferential orientation of said rotor, said first circumferential orientation providing a greater obstruction to said flow of drilling fluid than that of said second rotor circumferential orientation, whereby rotation of said rotor generates 1) a pressure drop in said drilling fluid across said rotor, and 2) as a series of pulses encoded with said information to be transmitted;

c) a gap formed between said rotor and said stator, rotor and stator capable of relative displacement with respect to each other during rotation of the rotor, wherein displacement of said rotor toward said stator reduces said gap, and displacement of said rotor away from said stator increases said gap; and d) a spring arranged so that deflection of said spring generates a biasing force resisting relative displacement between said rotor and said stator.

2. The rotary pulser according to claim 1, wherein an increase in said pressure drop across said rotor displaces said rotor away from said stator against said biasing force generated by said spring so as to increase said gap.

3. The rotary pulser according to claim 1, wherein said rotor defines an axis, and wherein said gap is an axial gap extending in a direction parallel to said axis.

4. The rotary pulser according to claim 1, wherein said spring comprises a Belleville spring.

5. The rotary pulser according to claim 1, wherein said rotor is slidably mounted on a rotor shaft, whereby displacement of said rotor relative to said stator is accomplished by said rotor sliding on said shaft.

6. The rotary pulser according to claim 1, wherein said rotor is slidably mounted in a housing coupled to said stator, whereby displacement of said rotor relative to said stator is accomplished by said rotor sliding within said housing.

7. The rotary pulser according to claim 1, wherein said rotor is mounted on a rotor shaft, whereby displacement of said rotor relative to said stator is accomplished by displacing said rotor shaft relative to said stator.

8. The rotary pulser according to claim 1, further comprising means for imparting a preload force to said spring.

9. The rotary pulser according to claim 1, further comprising a nut for imparting a preload force to said spring.

10. The rotary pulser according to claim 9, further comprising a stub shaft mounted on an end of said rotor shaft, said spring mounted between said nut and said stub shaft.

11. The rotary pulser according to claim 1, wherein said rotor is mounted on a rotor shaft, and further comprising a stub shaft mounted on an end of said rotor shaft, said spring mounted adjacent said stub shaft.

12. A rotary pulser configured to transmit information from a portion of a drill string operating at a down hole location in a well bore, said drill string having a passage through which a drilling fluid flows, the flow rate of drilling fluid through said passage varying over time, comprising:

a pulser adapted to be mounted in said drill string and to permit at least a portion of said drilling fluid to flow therethrough, the pulser including a stator and a rotor spaced from the stator along an axial direction so as to define a gap that extends from the stator to the rotor along the axial direction, said rotor being rotatable into at least first and second circumferential orientations, said first circumferential orientation providing a greater obstruction to said flow of drilling fluid than that of said second circumferential orientation, such that, when drilling fluid is flowing through the pulser, rotation of said rotor generates 1) a pressure drop across and the rotor that varies with variations in the flow rate of the drilling fluid, and 2) a series of pressure pulses encoded with said information to be transmitted, wherein at least one of the rotor and the stator are displaceable relative to each other along the axial direction as the rotor rotates between the at least first and second circumferential orientations to adjust the gap, whereby adjustment of the gap attenuates changes in the pressure drop across the rotor caused by variations in the flow rate of the drilling fluid.

13. The rotary pulser according to claim 12, further comprising a housing configured to be mounted to an inner surface of the drill string, wherein the stator is mounted to the housing, wherein the housing and rotor at least partially defines a leakage path for drilling fluid around said rotor, said leakage path having a flow area that is configured to be adjusted in response to said variations in said drilling fluid flow rate.

14. The rotary pulser according to claim 13, wherein the rotor is disposed in a downhole direction relative to the stator.

15. The rotary pulser according to claim 12, wherein said rotor defines an axis that is aligned with the axial direction, and wherein said gap extends a distance from the stator to the rotor along the axial direction.

16. The rotary pulser according to claim 14, wherein said further comprising a for generating a force biasing said rotor toward said stator.

17. The rotary pulser according to claim 16, wherein said biasing means comprises a spring.

18. The rotary pulser according to claim 17, wherein said spring comprises a Belleville spring.

19. The rotary pulser according to claim 16, wherein said biasing force generating means comprises means for applying a preload force to said rotor that resists movement of said rotor away from said stator.

20. The rotary pulser according to claim 12, wherein said pressure drop of said fluid across said rotor generates an axial force driving said rotor in a downstream direction, wherein the pulser includes a spring that biases said rotor toward said stator, wherein deflection of said spring generates a force that opposes said axial force generated by said pressure drop.

21. A method of transmitting encoded information from a portion of a bottom hole assembly of a drill string operating at a down hole location in a well bore to a location proximate the surface of the earth, a drilling fluid flowing through said drill string, said method comprising the steps of:

a) obtaining data from a sensor located in said downhole portion of said drill string;

b) rotating a rotor of a pulser mounted in said drill string proximate a stator so as to generate a first series of pressure pulses in said drilling fluid into which information concerning said sensor data has been encoded, said first series of pressure pulses associated with a first pressure drop across said rotor that imparts a first force to said rotor;

c) subsequently rotating said rotor so as to generate a second series of pressure pulses in said drilling fluid into which information concerning said sensor data has been encoded, said second series of pressure pulses associated with a second pressure drop across said rotor that imparts a second force to said rotor;

d) altering said pulser in situ in response to a difference between said first and second pressure drops across said rotor so as to attenuate said difference.

22. The method of transmitting encoded information according to claim 21, wherein said pulser comprises a leakage flow path that allows drilling fluid to flow around said rotor, and wherein the step of altering said pulser in situ in response to a difference between said first and second pressure drops across said rotor so as to attenuate said difference comprises automatically varying the flow area of said leakage flow path in response to said difference between said first and second pressure drops.

23. The method of transmitting encoded information according to claim 22, wherein said leak flow path comprises a gap formed between said rotor and said stator, and wherein the step of automatically varying the flow area of said leakage flow path comprises varying the size of said gap.

24. The method of transmitting encoded information according to claim 23, wherein the step of varying the size of said gap comprises displacing said rotor relative to said stator in response to a difference between said first and second pressure drops.

25. The method of transmitting encoded information according to claim 24, wherein a spring is coupled to said rotor so that displacement in said spring creates a force resisting displacement of said rotor away from said stator, whereby the step of displacing said rotor relative to said stator causes a displacement in said spring that resists said displacement of said rotor.

26. The method of transmitting encoded information according to claim 24, wherein the step of varying the size of said gap comprises displacing said rotor relative to said stator in response to a difference between said first and second pressure drops comprises increasing the size of said gap when said second pressure drop is greater than said first pressure drop and decreasing the size of said gap when said second pressure drop is less than said first pressure drop.

27. The method of transmitting encoded information according to claim 21, wherein said pulser is altered only when said second pressure drop exceeds a predetermined threshold.

28. A method of transmitting encoded information from a portion of a bottom hole assembly of a drill string operating at a down hole location in a well bore to a location proximate the surface of the earth, a drilling fluid flowing through said drill string, said method comprising the steps of:

a) obtaining data from a sensor located in said downhole portion of said drill string;

b) flowing said drilling fluid through a pulser mounted in said drill string proximate a stator, rotating a rotor of said pulser so as to generate a series of pressure pulses in said drilling fluid into which information concerning said sensor data has been encoded, said series of pressure pulses associated with a pressure drop across said rotor; and c) altering said pulser in situ in response to variations in the flow rate of said drilling fluid through said pulser so as to attenuate changes in said pressure drop across said rotor resulting from variations in said flow rate of said drilling fluid.

29. The method of transmitting encoded information according to claim 28, wherein said pulser comprises a leakage flow path that allows drilling fluid to flow around said rotor, and wherein the step of altering said pulser in situ in response to a variations in said drilling fluid flow rate so as to attenuate changes in said drop comprises automatically varying the flow area of said leakage flow path in response to a variation in said drilling fluid flow rate.

30. The method of transmitting encoded information according to claim 29, wherein said leak flow path comprises a gap formed between said rotor and said stator, and wherein the step of automatically varying the flow area of said leakage flow path comprises varying the size of said gap.

31. The method of transmitting encoded information according to claim 30, wherein the step of varying the size of said gap comprises displacing said rotor relative to said stator in response to a difference between said first and second pressure drops.

32. The method of transmitting encoded information according to claim 31, wherein a spring is coupled to said rotor so that displacement in said spring creates a force resisting displacement of said rotor away from said stator, whereby the step of displacing said rotor relative to said stator causes a displacement in said spring that resists said displacement of said rotor.

33. The rotary pulser according to claim 15, wherein the pulser is configured such that 1) an increase in the pressure drop causes the distance of the gap to decrease, and 2) a decrease in the pressure drop gap causes the gap distance to increase.

* * * * *